US007246924B2

(12) United States Patent
Pfund

(10) Patent No.: US 7,246,924 B2
(45) Date of Patent: Jul. 24, 2007

(54) HIGH PERFORMANCE LIGHTING LOUVERS AND LUMINAIRES

(75) Inventor: David R Pfund, Woodbridge, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 211 days.

(21) Appl. No.: 10/995,928

(22) Filed: Nov. 22, 2004

(65) Prior Publication Data

US 2006/0109652 A1 May 25, 2006

(51) Int. Cl.
*F21V 11/02* (2006.01)

(52) U.S. Cl. ..... 362/325; 362/290; 362/291; 362/292

(58) Field of Classification Search ..... 362/342, 362/290, 291, 292, 325, 279
See application file for complete search history.

(56) References Cited

U.S. PATENT DOCUMENTS

| | | | | |
|---|---|---|---|---|
| 2,971,083 | A | 2/1961 | Phillips et al. | |
| 4,059,754 | A | 11/1977 | Lewin | |
| 4,621,309 | A | 11/1986 | Grawe et al. | |
| 5,008,791 | A | 4/1991 | Caferro | |
| 5,149,191 | A | 9/1992 | Lewin et al. | |
| 5,486,989 | A | 1/1996 | Compton | |
| 5,528,478 | A * | 6/1996 | Degelmann | 362/290 |
| 5,586,015 | A | 12/1996 | Baldwin et al. | |
| D378,860 | S * | 4/1997 | Galletly | D26/77 |
| 6,139,169 | A * | 10/2000 | Caferro | 362/291 |
| 6,402,345 | B1 | 6/2002 | Fishman | |
| 6,626,560 | B1 | 9/2003 | Caferro et al. | |

OTHER PUBLICATIONS

"Angleflux" Web site page, Scientific Lighting Products, Maryland Heights, Missouri, undated.
"Parabolic Louvers" Web site page, Scientific Lighting Products, Maryland Heights, Missouri, undated.
Drawing of discontinued product #IL-2-S-145, Scientific Lighting Products, Maryland Heights, Missouri, undated.
"Parawash, Linear Wall Wash" Web site pages, Columbia Lighting, Spokane, Washington, undated.
"Parawash, Cross Baffle Wall Wash" Web site pages, Columbia Lighting, Spokane, Washington, undated.
"Para-blade" data sheet, ALP Products, Chicago, Illinois, undated.

* cited by examiner

*Primary Examiner*—Laura Tso
(74) *Attorney, Agent, or Firm*—Cantor Colburn LLP

(57) ABSTRACT

Lighting louvers formed by transverse and longitudinal blades improve the performance of indirect ambient light luminaires by increasing light output, widening the output of the luminaire's maximum intensity light, or both. These lighting louvers include at least one of the following features: non-symmetrically shaped apertures, wider apertures over (or under) the luminaire's lamp(s), longitudinal blades of shorter height nearest the lamps, and longitudinal blades having differently curved longitudinal sides. Each of these features contributes to improved luminaire performance.

35 Claims, 44 Drawing Sheets

HIGH PERFORMANCE LIGHTING LOUVERS AND LUMINAIRES

BACKGROUND OF THE INVENTION

This invention relates to luminaire louvers. More particularly, this invention relates to louvers that are sized, shaped, and arranged to improve the performance of luminaires.

Luminaires (i.e., lighting units) can be used to provide indirect ambient lighting for interior spaces by directing some or all of their lighting to overhead surfaces. These types of luminaires are widely used in commercial installations where diffuse reflected light is desirable. They are especially common in office spaces, where such lighting is preferred for tasks involving video display terminals.

Luminaires for ambient lighting are commonly suspended from ceilings. They usually have housings that conceal or otherwise shield their lamp(s) from direct view, while directing light upwards through apertures in the top of the luminaire. To minimize glare and maximize visual comfort, these luminaires provide as even a distribution of light (i.e., no bright spots) over as wide an area as possible. Such uniformity of light can be economically attained by using luminaires that (1) are suspended as far as possible from the surface to be illuminated and (2) emit their maximum intensity light at low upward angles. Coincidently, increased setback and wide light distribution also advantageously result in the fewest number of luminaires and the lowest power density (watts per square foot).

However, suspension lengths are often limited, for example, by low ceiling heights, headroom issues, and the general notion that suspended lighting adds clutter to interior spaces. Even in known luminaires with relatively wide light spread distributions, limited suspension lengths often result in undesirable ceiling brightness and poor ceiling uniformity. In such cases, ceiling uniformity is especially compromised when luminaires are widely spaced to lower energy costs. Undesirable ceiling brightness and poor ceiling uniformity can cause reflected glare on display screens, increasing visual fatigue and reducing worker productivity.

Luminaires for ambient lighting also are commonly mounted to furniture systems and low office partitions. Mounting heights for such luminaires typically range from about 48" above the floor to about 65" above the floor. These luminaires advantageously eliminate overhead lighting and potentially create a visually clean, uncluttered, and spacious-appearing interior environment. Moreover, these luminaires may also have bottom apertures that provide local supplementary direct lighting for office tasks. This eliminates the need for auxiliary task lights and further reduces energy use. Because these luminaires are generally mounted farther from ceilings than suspended luminaires, they potentially create more diffuse ambient light characterized by lower ceiling luminances, greater uniformity of ceiling brightness, and greater visual comfort.

However, such furniture/partition mounted luminaires (i.e., indirect luminaires mounted below standing eye height) often have a housing with a large height profile to shield their lamps from direct view. Large height profiles can adversely affect the aesthetic appearance of an interior environment and can also adversely impact workstation functionality. For example, a panel-mounted luminaire with a large height profile may prevent a video display terminal from being positioned at the most desirable viewing location.

While some reduction in height profile is possible with shielding devices (e.g., baffle or louver assemblies, described in detail below), shielding devices can also adversely affect the performance of a luminaire and thus diminish the advantages furniture/partition mounted luminaires have over luminaires suspended from ceilings.

Luminaire performance for ambient light applications is determined by luminaire efficiency and the maximum intensity angle. Luminaire efficiency is the percentage of light generated by the luminaire's lamp(s) that is emitted from the luminaire; the closer to 100%, the higher the efficiency. The maximum intensity angle is the angle at which the maximum intensity light is emitted from the luminaire; the lower the angle, the wider the light distribution. Higher performance results from either higher efficiency, lower maximum intensity angle, or preferably both.

Effective shielding devices can contribute to performance by preventing luminaire lamp(s) from being directly viewed while advantageously directing lamp output at low angles that minimize glare (i.e., at angles near but not at or below the viewing angle). However, as mentioned above, shielding devices can also detract from luminaire performance.

For indirect luminaires employing linear type fluorescent lamps (e.g., 1" diameter T8 or ⅝" diameter T5 lamps) or long compact (twin-tube) fluorescent lamps, shielding is often performed by a baffle or louver assembly placed above the lamp(s) in much the same manner as a direct or downlight luminaire is fitted with a baffle or louver assembly below its lamp(s). Typically, such baffles or louvers are made of specular or semi-specular metal or metalized plastic fashioned to advantageously redirect light rays to prevent glare.

Baffle assemblies typically have vertical blades arranged transversely (crosswise) to the lamp length. These vertical blades extend between two side members arranged parallel to the length of the lamp. Multiple vertical blades are arranged along the lamp length between the side members to form a series of apertures through which lamp light passes. The spacing of the blades combined with their height and the angle of light reflecting off their surfaces determine the longitudinal shielding angle of the luminaire. Similarly, the distance between the baffle side members, the angle of light reflecting off their surfaces, and the vertical distance at which the lamp is positioned below the top of the baffle sides determine the lateral or transverse shielding angle of the luminaire.

A significant disadvantage of baffle assemblies involves the transverse shielding angle, transverse aperture width, and luminaire height profile. For a given lamp type, indirect luminaires with wide baffle assemblies, which advantageously result in greater overall efficiency with wider light distributions and greater light intensity at lower vertical angles, require the lamp to be located far below the aperture in order to have acceptable lateral shielding. This results in luminaires that are undesirably bulky with noticeably large height profiles, which can compromise the appearance of a space and limit workstation functionality.

Louver assemblies generally combine a series of transverse (baffle) blades with longitudinal blades positioned between the side members and parallel to the lamp length. (As used herein, "transverse blade" and "cross blade" mean the same thing and are interchangeable.) These transverse and longitudinal blades create an array of multiple, usually rectangular, apertures through which lamp light passes. The result is an assembly wherein the spacing of the transverse and longitudinal blades, their respective heights, and the angle of light reflecting off their surfaces determine the longitudinal and transverse shielding angles of the luminaire.

Generally, the vertical position of the lamp from the louver assembly has little to no effect on the shielding angle. Thus, luminaire height profile can be advantageously reduced to little more than the lamp diameter and louver height. To the extent that reduced louver blade spacings allow for reduced louver height without compromising the shielding angle, very low profile luminaires can be advantageously constructed.

Uniform louver assemblies having transverse and longitudinal blades of equal heights, spacings, and surface profiles are very common. They typically are used to construct low-profile, low-brightness luminaires with consistent vertical shielding from all horizontal viewing angles regardless of the position, orientation, and number of lamps (light sources).

Such uniform louver assemblies, however, have two disadvantages. The first disadvantage adversely affects the efficiency of the luminaire. When louver blades are closely spaced to reduce louver height (and thus advantageously reduce the luminaire height profile) while maintaining the shielding angle, the number and total cross-sectional area of louver blades increases, causing the total open aperture area of the louver to accordingly decrease. This increases the interception and reflection of light rays by louver blades. Typically, luminaire louver blades have a surface reflectance of about 85% to 90%, meaning that about 10% to 15% of the light striking the surface is absorbed (i.e., lost). Consequently, the overall light output of the luminaire decreases and the amount of energy (wattage) required to produce a given lighting level increases. The efficiency and overall performance of the luminaire are therefore lower.

The second disadvantage of uniform louver assemblies adversely affects the maximum intensity angle. Normally, light rays entering the louver assembly either emanate directly from the lamp or have been redirected to desirable angles by a luminaire reflector. Louvers therefore should only intercept and redirect those light rays emanating directly from the lamp at undesirable angles (i.e., those light rays that have the potential to cause direct brightness and glare). However, some louver blades intercept light rays that are already directed at desirable angles, while not intercepting light rays directed at undesirable angles. This is especially common with respect to longitudinal louver blades in single-lamp linear fluorescent luminaires. Each time a light ray encounters a louver blade surface, it is redirected at a generally higher angle. Thus, redundant louver reflections cause the luminaire output to become more concentrated and to exit the aperture at higher vertical angles. This reduces the luminaire's ability to output high intensities at low vertical angles (i.e., near the shielding angle) and disadvantageously leads to less light diffusion and reduced surface (e.g., ceiling) uniformity. This, in turn, adversely affects visual comfort and the general appearance of a space.

In view of the forgoing, it would be desirable to be able to provide a louver assembly that improves the performance of luminaires used for indirect ambient lighting.

It would also be desirable to be able to provide a louver assembly that improves luminaire efficiency.

It would further be desirable to be able to provide a louver assembly that produces a wide spread light distribution pattern with maximum light intensities at low vertical angles.

SUMMARY OF THE INVENTION

It is an object of this invention to provide a louver assembly that improves the performance of luminaires used for indirect ambient lighting.

It is also an object of this invention to provide a louver assembly that improves luminaire efficiency.

It is further an object of this invention to provide a louver assembly that produces a wide spread light distribution pattern with maximum light intensities at low vertical angles.

In accordance with the invention, a louver assembly is designed to be positioned in or over the light-emitting opening of a luminaire's housing. The luminaire includes a lampholder for a light source and preferably a reflector that redirects light from the source at desirable angles above a specified shielding angle. The louver assembly includes a plurality of longitudinal and transverse blades dividing the light-emitting opening into a plurality of apertures. The louver blades are sized, shaped, and arranged to (1) shield the light source from view at angles less than the shielding angle, (2) improve luminaire efficiency, and (3) produce a wide spread light distribution pattern with maximum light intensities at low vertical angles. The louver assembly advantageously reduces the unintended interception and redirection of desirable direct and reflected light rays exiting the opening of the luminaire.

Embodiments of the louver assembly include one or more of the following features in accordance with the invention: differently sized apertures, louver blades having different curvatures on their longitudinal sides, transversely wider apertures directly over (or under) the luminance's lamp(s) (e.g., no longitudinal louver blades centered over (or under) the lamp(s)), longitudinal louver blades that are non planar with transverse louver blades, and louver blades having different heights.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
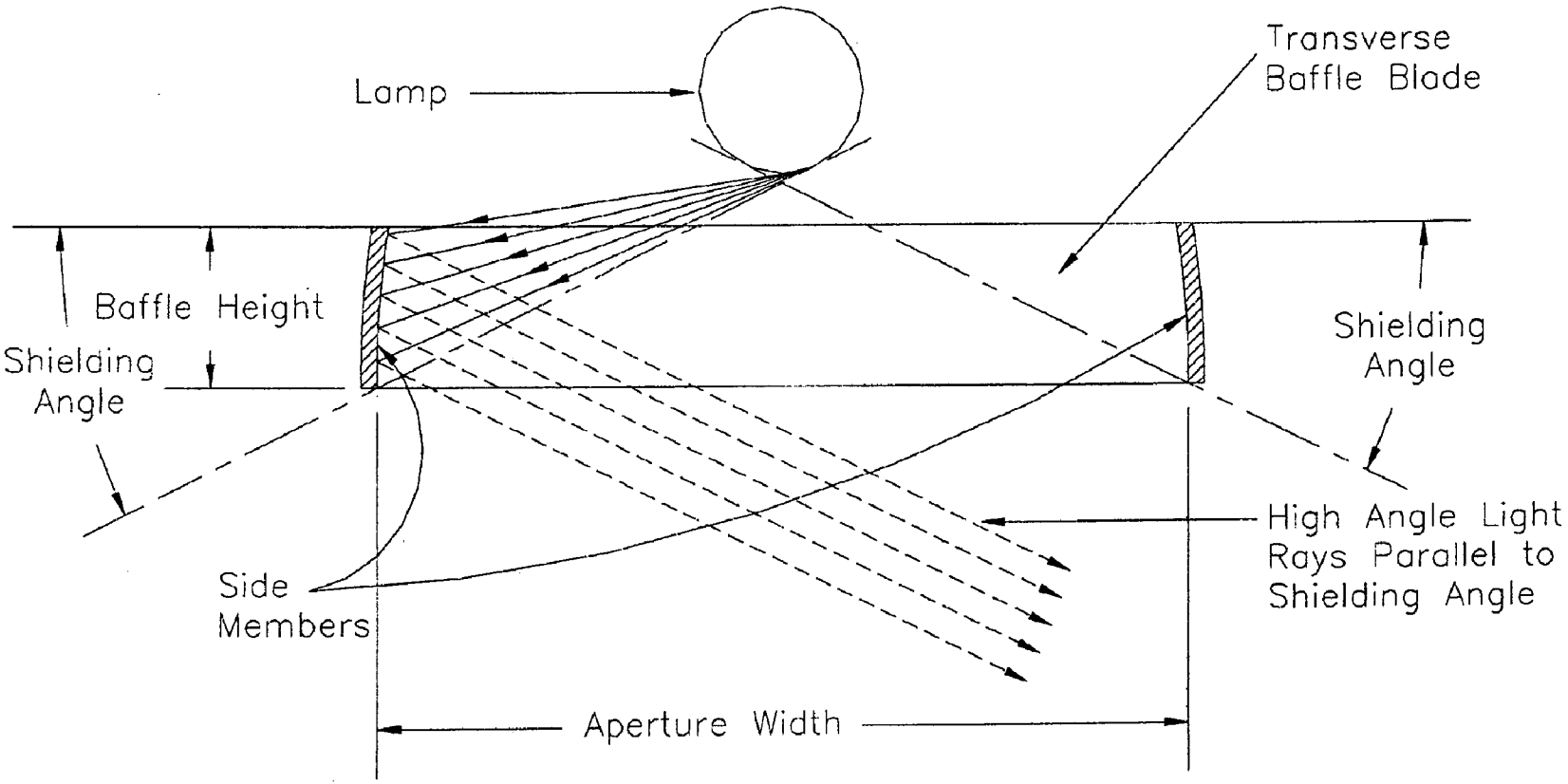
PRIOR ART FIG. 1
FIGS. 1 and 2 are cross-sectional and partial longitudinal views, respectively, of a typical baffle assembly.
Figure 2:
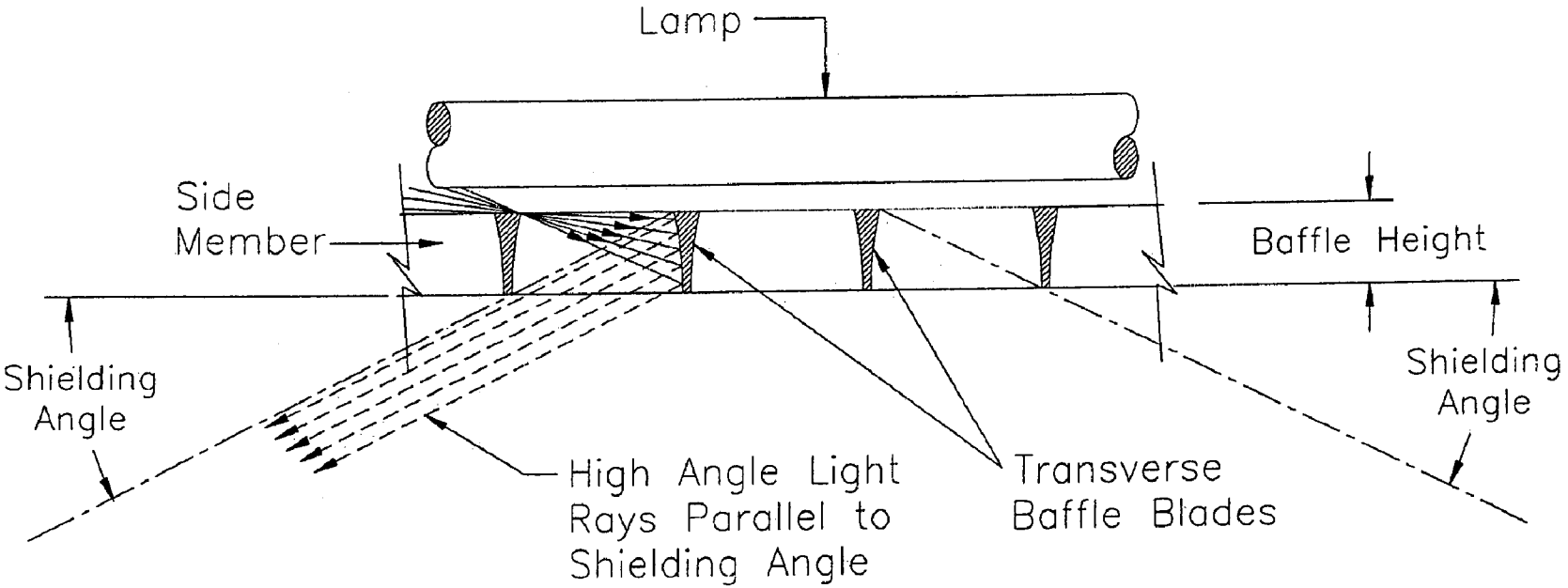
FIG. 2 PRIOR ART

FIGS. 1 and 2 illustrate how a typical low-brightness baffle assembly controls glare by establishing a shielding angle. Side members and cross (transverse) baffle blades intercept light rays that exit the lamp within the shielding angle. The baffle side members and cross blades are formed with curved profiles and specular finishes to control the redirected rays such that they exit the luminaire in desirable directions that do not violate the shielding angle. Consequently, the viewer is not subjected to direct brightness from the lamp or reflected brightness from the baffle side members and cross blades when viewing the luminaire at sightlines within the shielding angle. The baffle side members advantageously cause the highest angle reflected rays to exit the luminaire parallel to the shielding angle. This contributes to a wide spread distribution. Internal reflectors typically direct all other light rays exiting the luminaire away from the shielding angle. Such luminaires commonly achieve a desirable low-brightness appearance.

Figure 3:
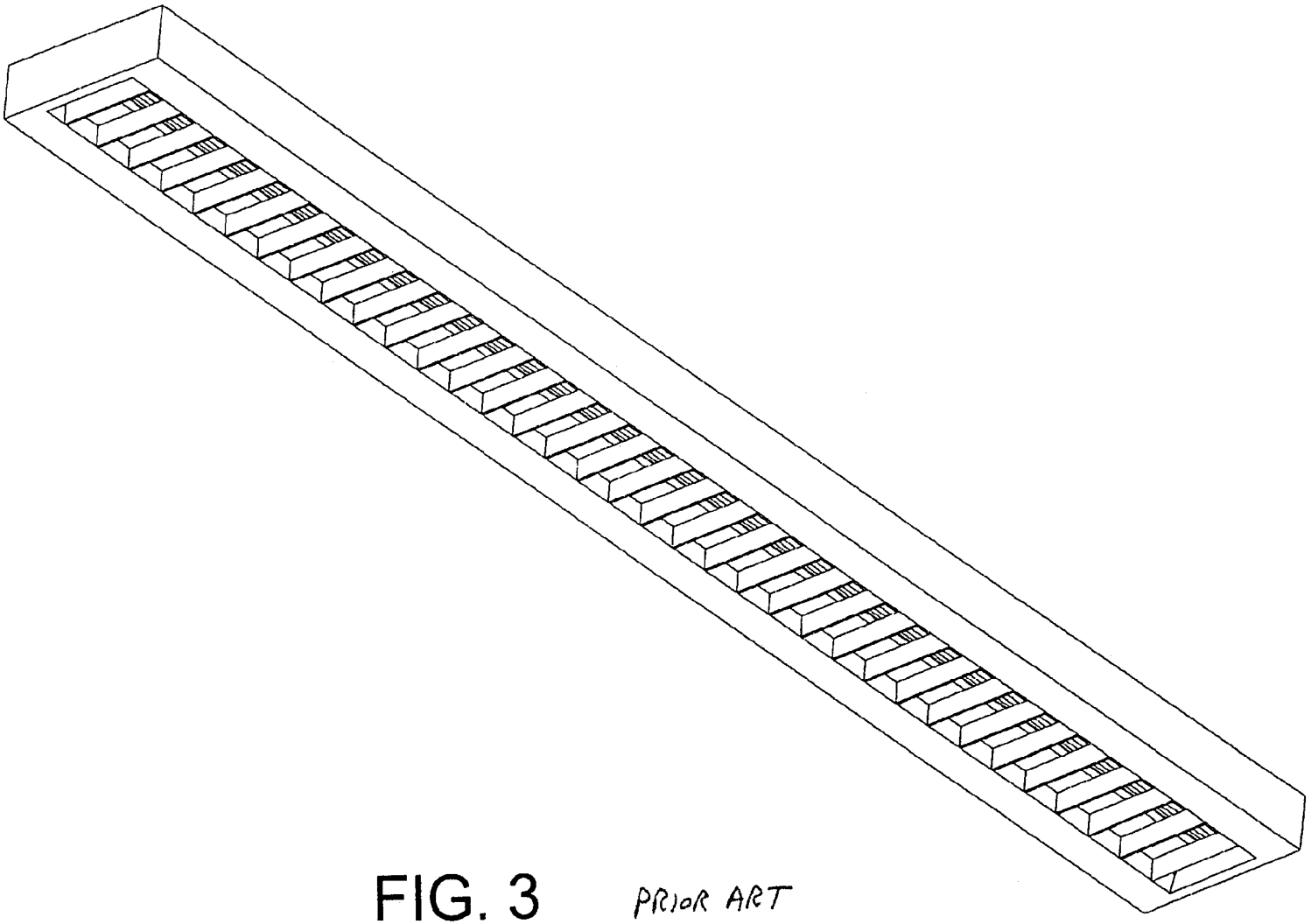
FIG. 3 PRIOR ART
FIG. 3 is a perspective view of a luminaire employing the baffle assembly of FIGS. 1 and 2.
Figure 4A:
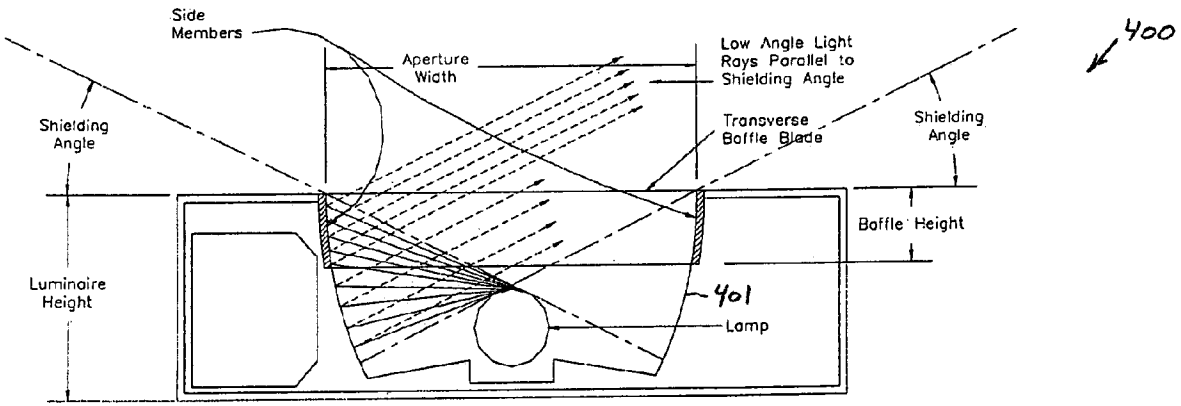
FIG. 4a PRIOR ART
FIGS. 4*a,b* are cross-sectional and partial longitudinal views, respectively, of the luminaire of FIG. 3 positioned for uplighting.
Figure 4B:
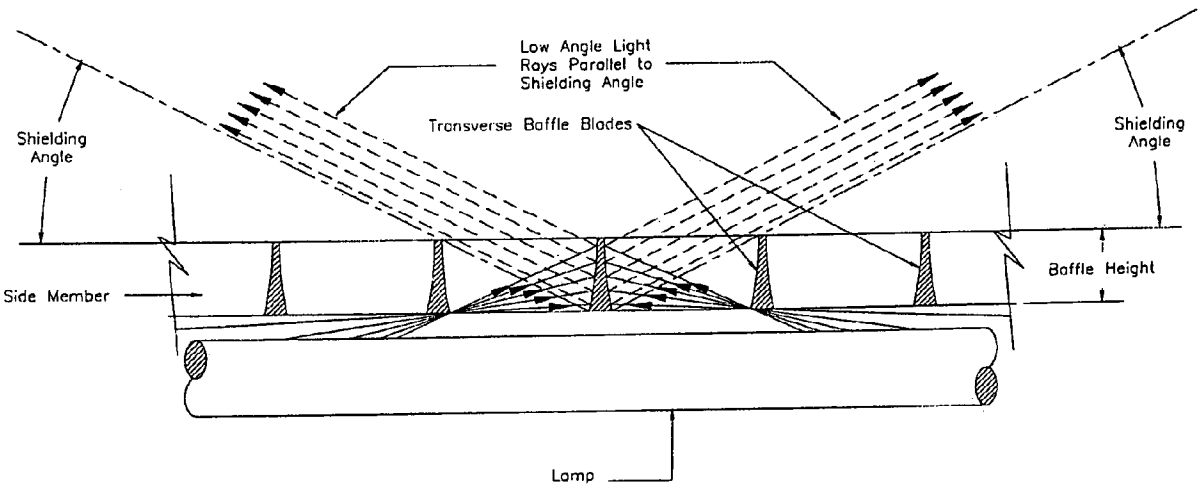
FIG. 4b PRIOR ART

Baffles are commonly used in downlight luminaires, as shown in FIG. 3, but are also equally effective for uplighting, as shown in FIGS. 4*a,b*. However, for a given size lamp and shielding angle, the minimum luminaire height profile is dictated by the aperture width. That is, as the aperture width increases, the luminaire height profile increases (because the lamp needs to be positioned farther away from the aperture in order to maintain the shielding angle) and vice versa.

Figure 5:
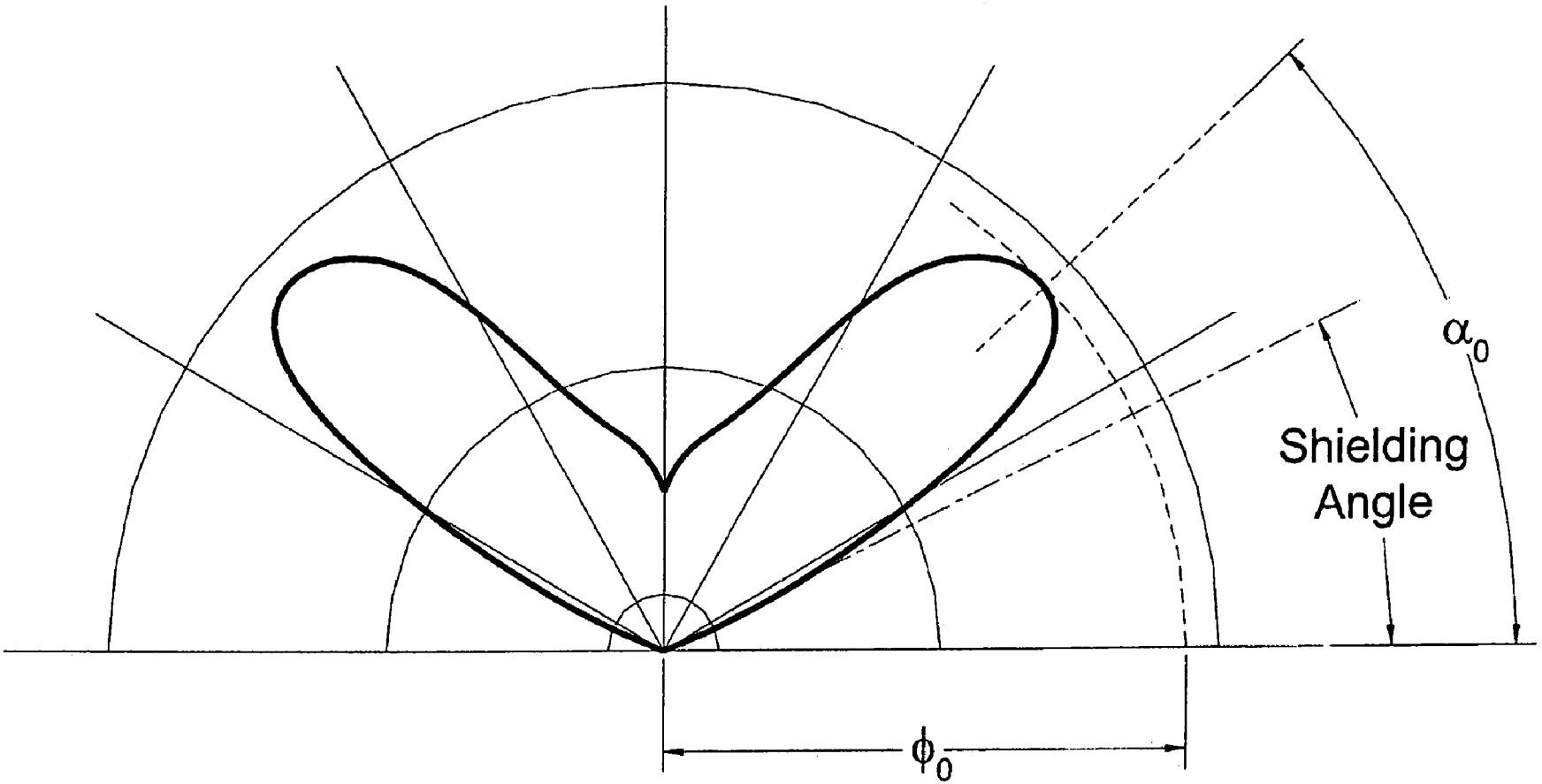
FIG. 5 PRIOR ART
FIG. 5 is a candlepower distribution curve representing the luminous output in the transverse plane of the luminaire of FIG. 4*a;*

The candlepower distribution curve shown in FIG. 5 illustrates the performance of luminaire 400 in which the lamp is a linear fluorescent and, in addition to the baffle assembly, internal reflectors 401 redirect light at (low) angles that do not violate the shielding angle. Commonly, this is referred to as a wide spread or "batwing" distribution. In particular, $\phi 0$ is the maximum light intensity produced by luminaire 400, angle $\alpha 0$ is the angle of maximum light intensity, and the shielding angle is 26°.

Figure 6:
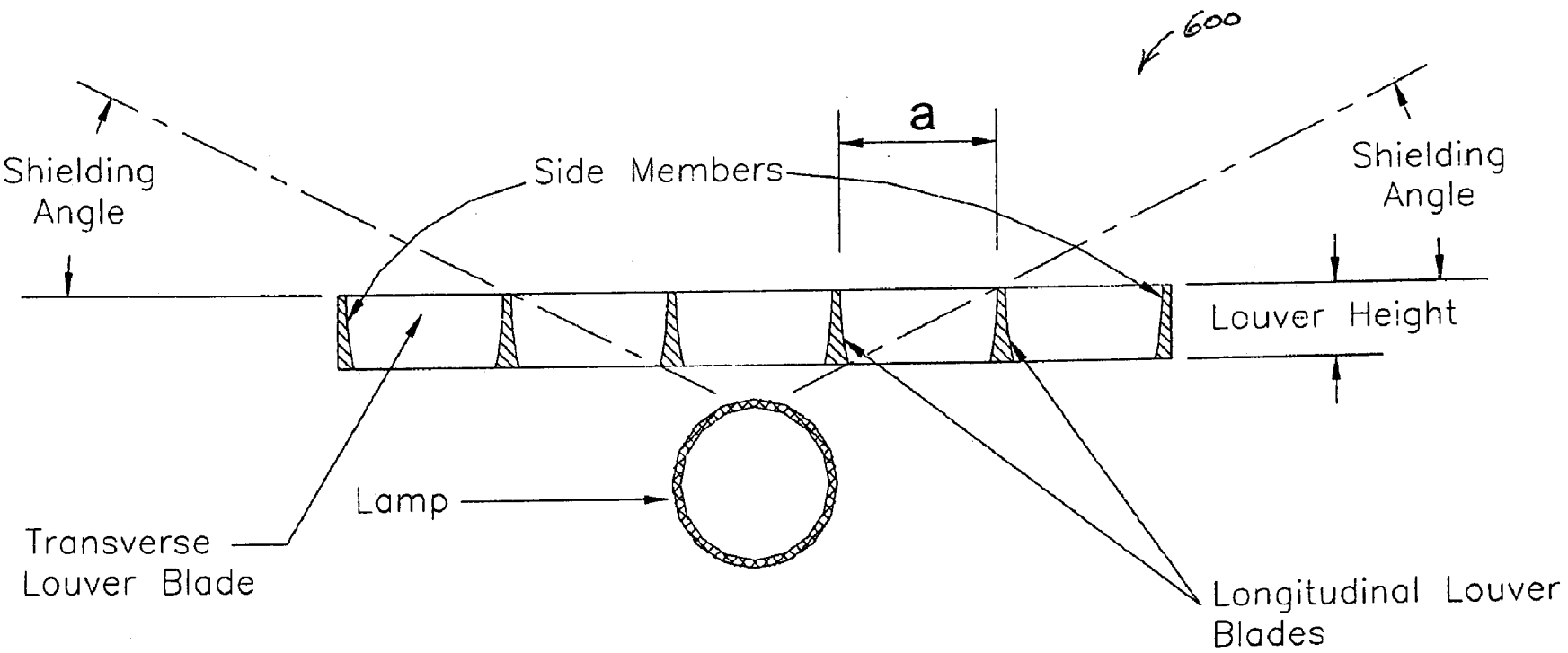
FIG. 6 PRIOR ART
FIGS. 6–8 are cross-sectional, partial longitudinal, and partial perspective views, respectively, of a typical uniform louver assembly.
Figure 7:
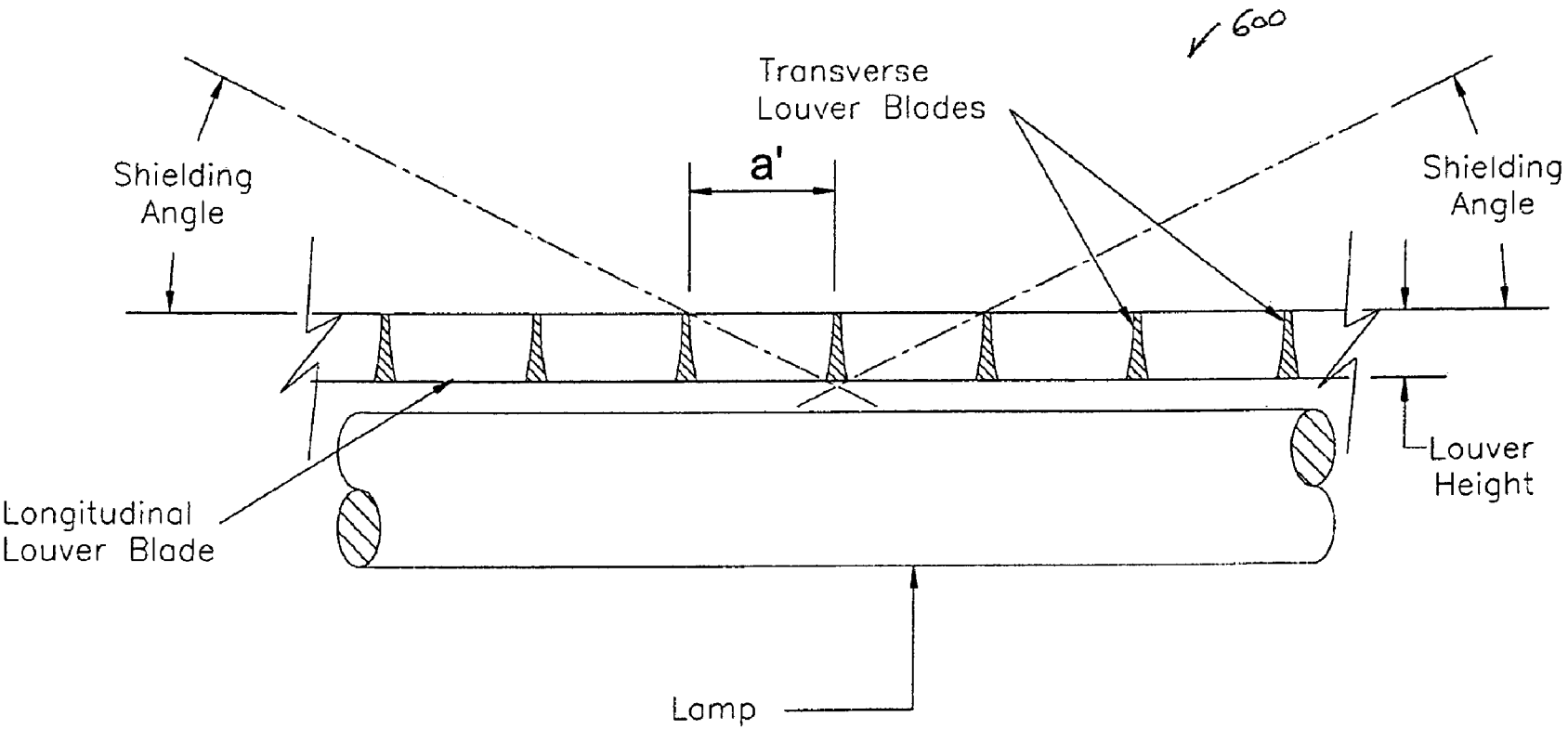
FIG. 7 PRIOR ART
Figure 8:
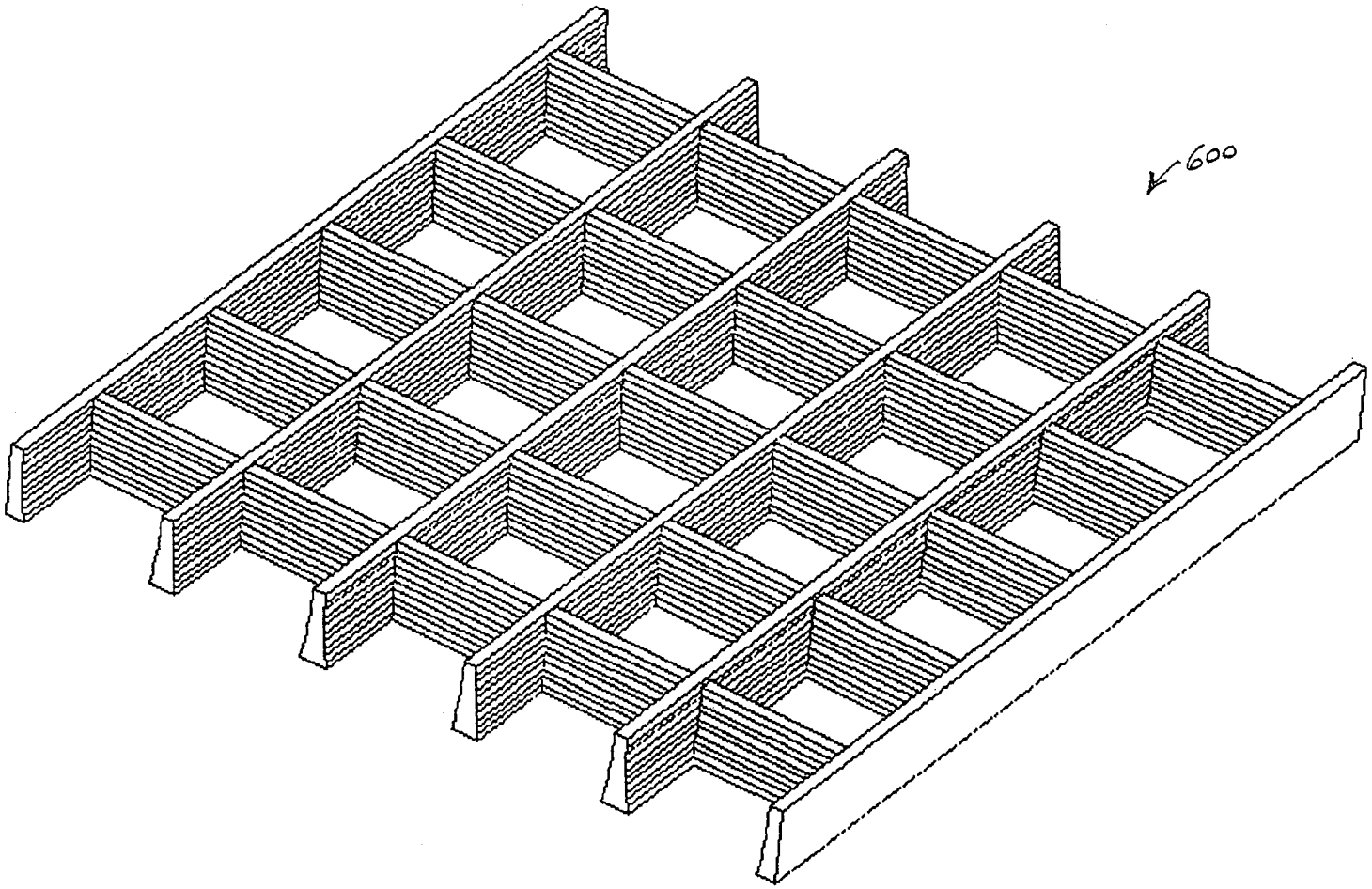
FIG. 8 PRIOR ART

FIGS. 6 and 7 illustrate how a typical louver assembly controls glare by establishing a shielding angle. A shielding angle is determined by the louver height and blade spacing. The use of contoured side members and louver blades along with specular finishes is known to achieve low-brightness and high performance. The height of each longitudinal and transverse louver blade is commonly equal to the louver height and, although slight variations in blade surface profiles may require louver blade spacings a and a' to vary slightly from each other and across the transverse width of the louver, the louver blades and side members are essentially arranged in a uniform array as shown in FIG. 8. As with baffles, louvers are equally applicable to downlight and uptight applications.

Notably, however, the luminaire shielding angle and minimum luminaire height are not a function of aperture width. Luminaire shielding angle is solely a function of blade spacing (e.g., a or a') and louver height as defined in FIGS. 6 and 7. Consequently, variations in aperture width and lamp position do not affect the shielding angle and, for any given lamp size and position, the minimum luminaire height profile is defined by the louver height.

Figure 9:
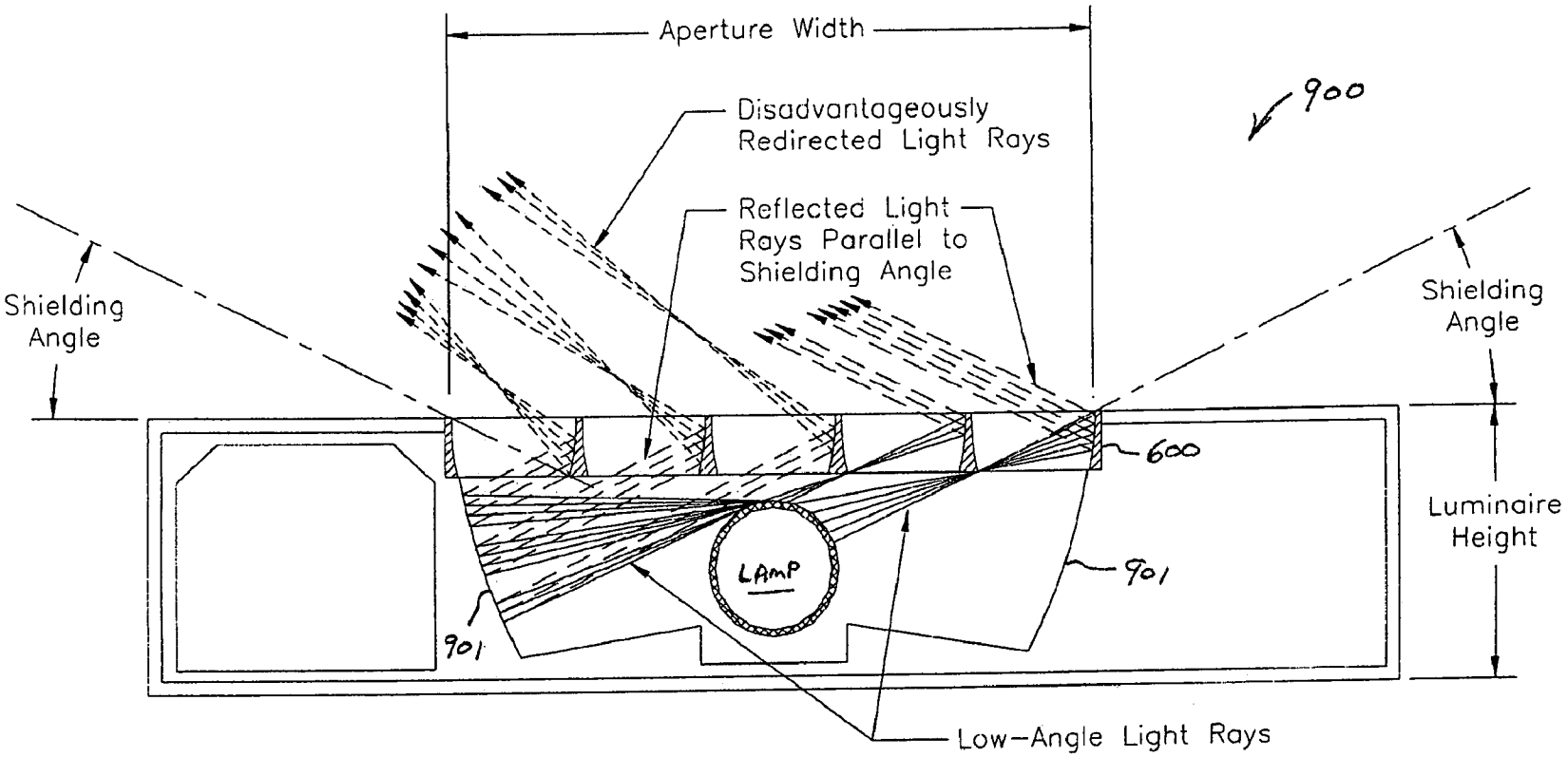
FIG. 9 PRIOR ART
FIG. 9 is a cross-sectional view of a luminaire with a typical louver assembly showing disadvantageous redirection of light rays.

FIG. 9 illustrates how uniform louver blade contours (i.e., side profiles/curvatures/shapes) limit performance. In this example, the louver side members and both sides of each of the longitudinal louver blades have identical parabolic shapes. Light rays emanating directly from the lamp that strike the inside surface of the longitudinal blades (i.e., the surface facing the lamp) are advantageously redirected at an angle parallel to the shielding angle. However, light rays striking the outside surface of the longitudinal blades (i.e., the surface facing away from the lamp) have already been redirected at advantageous angles close to the shielding angle by luminaire reflector 901. The subsequent redirection (to higher angles) by the parabolic louver surfaces of these already reflected lights rays is undesirable and diminishes the wide spread output of the luminaire.

Figure 10:
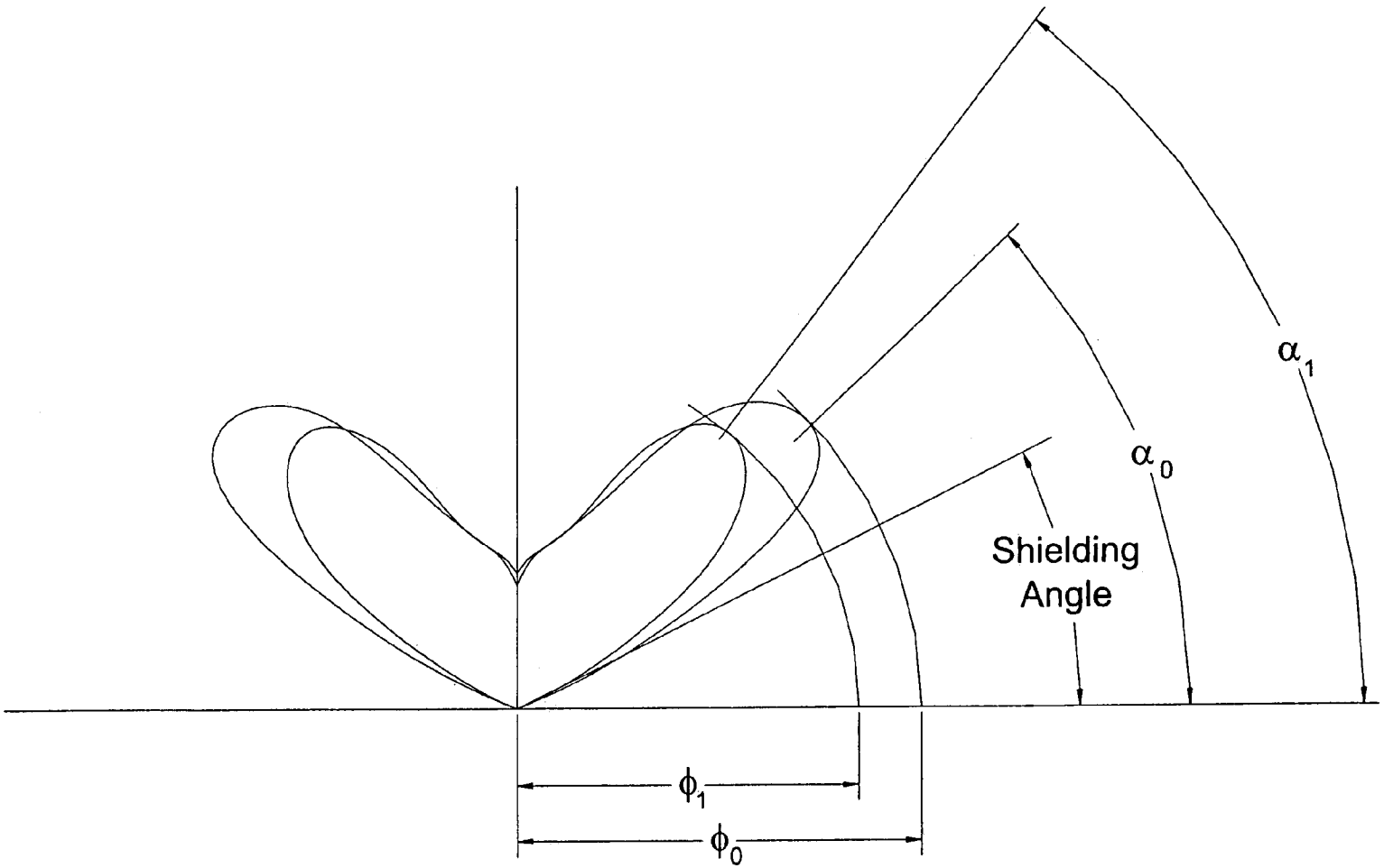
FIG. 10 (PRIOR ART)
FIG. 10 is a candlepower distribution curve representing the luminous output in the transverse plane of the luminaires of FIGS. 4*a* and 9.

The result is illustrated in FIG. 10, where the performance of luminaire 900 is compared with the performance of luminaire 400 (which has the baffle). In particular, louver 600 results in a maximum light intensity of $\phi$1 and an angle of maximum intensity $\alpha$1. The shielding angle again is 26°. Notably, although a lower profile luminaire can be constructed with the louver, peak candlepower in the transverse plane is significantly reduced and the difference between the peak candlepower angle $\alpha$1 and the shielding angle is significantly greater than that obtained with a baffle assembly.

Figure 11:
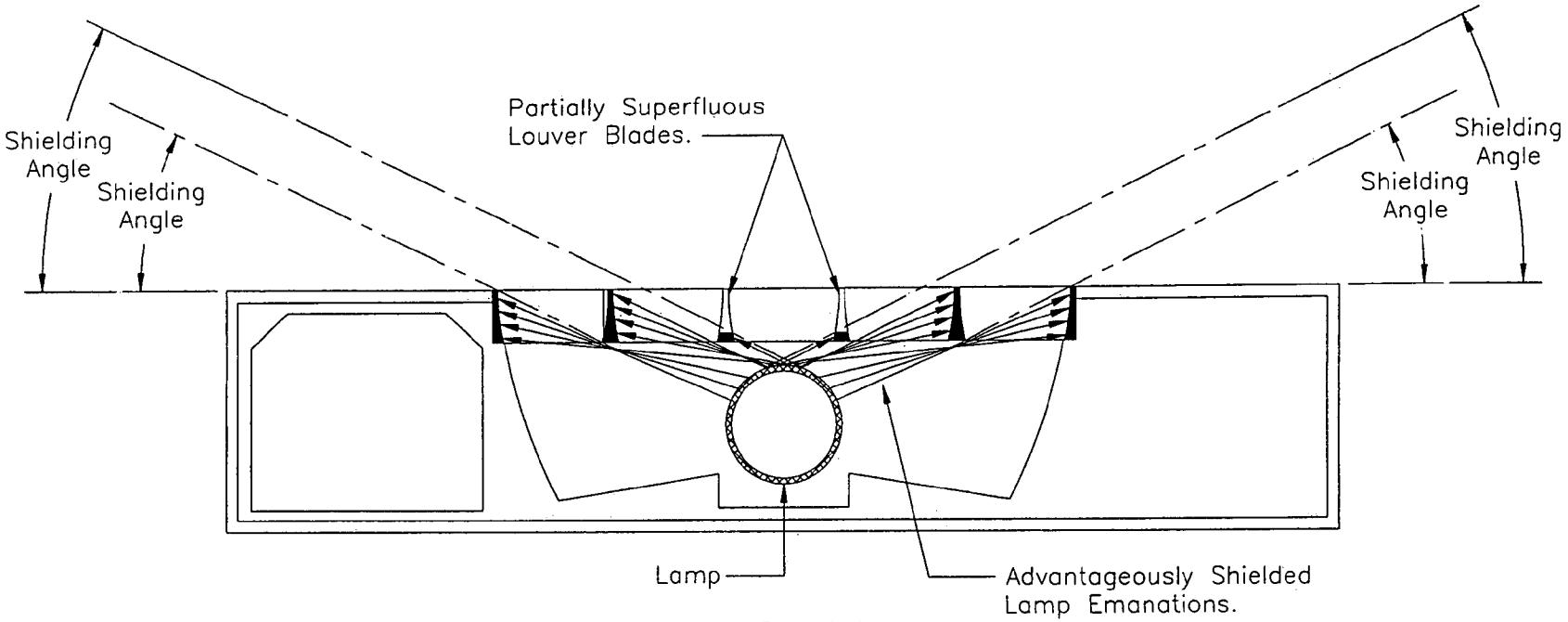
FIG. 11 PRIOR ART
FIGS. 11–13 are cross-sectional views of a luminaire with a typical louver assembly showing advantageous interception of undesirable lamp emanations, disadvantageous redirection of lamp emanations, and disadvantageous interception of advantageously reflected light rays, respectively.
Figure 12:
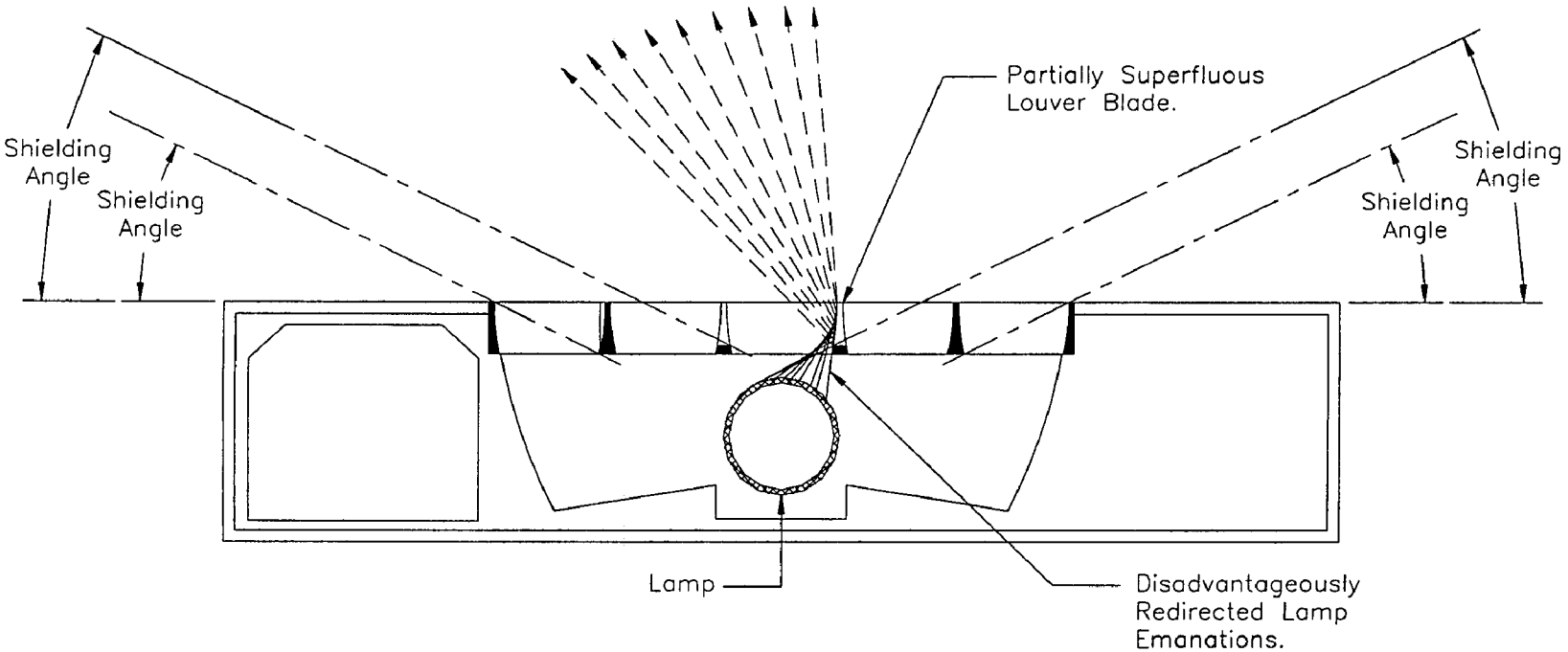
FIG. 12 (PRIOR ART)
Figure 13:
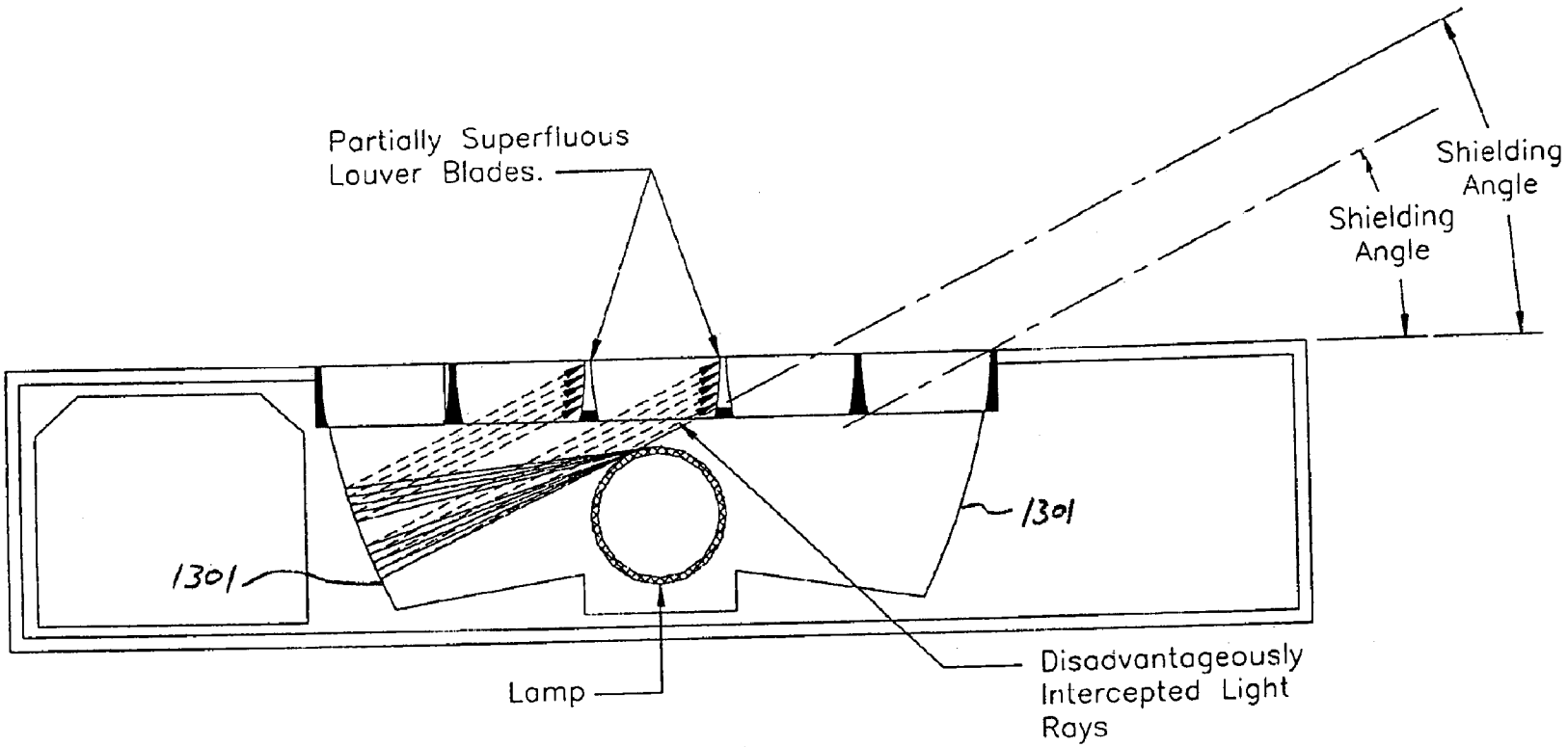
FIG. 13 PRIOR ART

FIGS. 11–13 further illustrate how a known louver assembly limits the performance of luminaires. Note that in the known louver embodiment shown, the lamp is positioned between and below two longitudinal louver blades. The unshaded portions of those two longitudinal louver blades are superfluous. That is, they add nothing to the establishment of a shielding angle and do not improve luminaire performance. As shown in FIG. 11, they do not intercept undesired direct lamp emanations, and thus do not contribute to reducing glare. To the contrary, as shown in FIG. 12, those superfluous louver blade segments disadvantageously intercept desirable lamp emanations (exiting the lamp above the shielding angle). Moreover, other desirable light rays, which had already been desirably reflected by reflector 1301, as shown in FIG. 13, are similarly undesirably intercepted by the two superfluous louver blade segments. As described previously, these unnecessary interceptions negatively impact luminaire efficiency. Furthermore, in typical uniform louver assemblies (where all louver blades are identically fashioned to elevate, by reflection, low-angle lamp rays to angles above the shielding angle), the superfluous louver blade sections only disadvantageously redirect desirable light rays to angles farther away from the shielding angle and thus do not contribute to achieving a wide spread distribution (see, e.g., FIG. 12).

Figure 14:
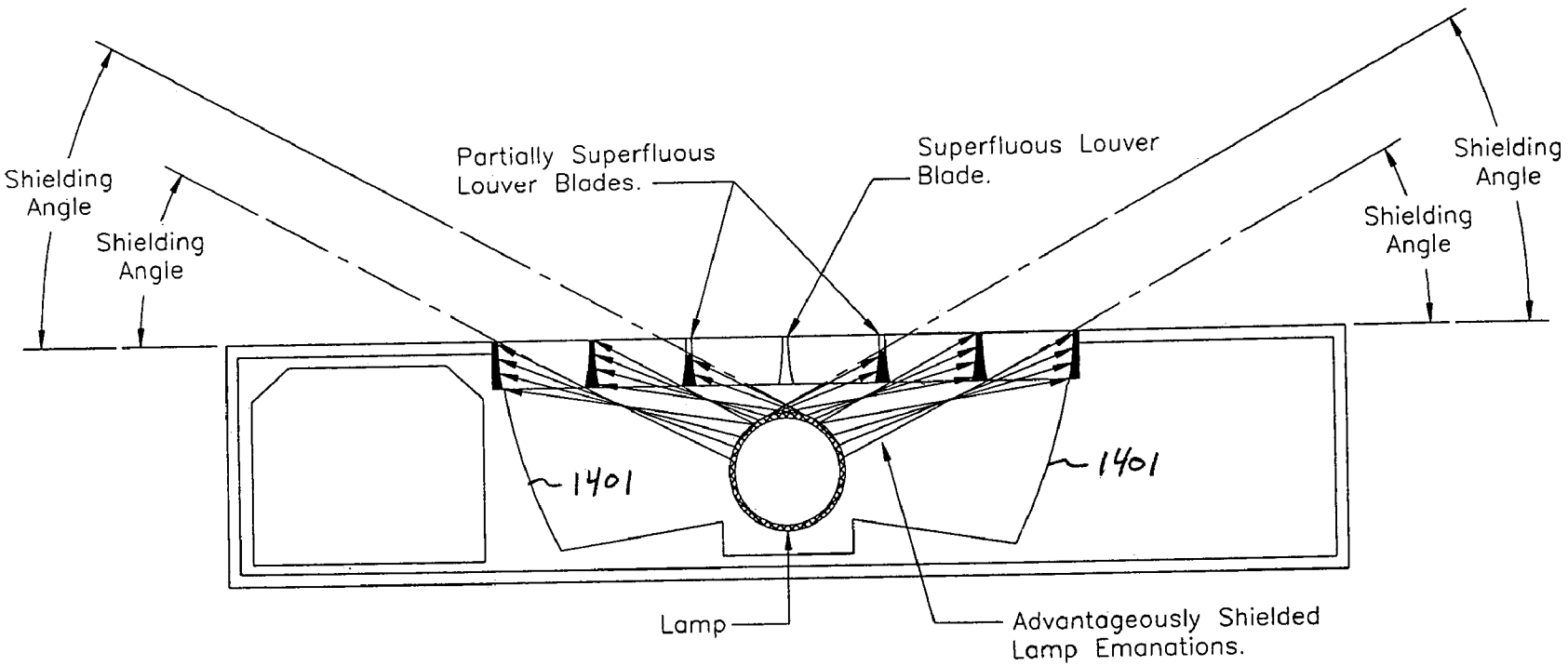
FIG. 14 (PRIOR ART)
FIGS. 14–16 are cross-sectional views of a luminaire with another embodiment of a typical louver assembly showing advantageous interception of undesirable lamp emanations, disadvantageous redirection of lamp emanations, and disadvantageous interception of advantageously reflected light rays, respectively.
Figure 15:
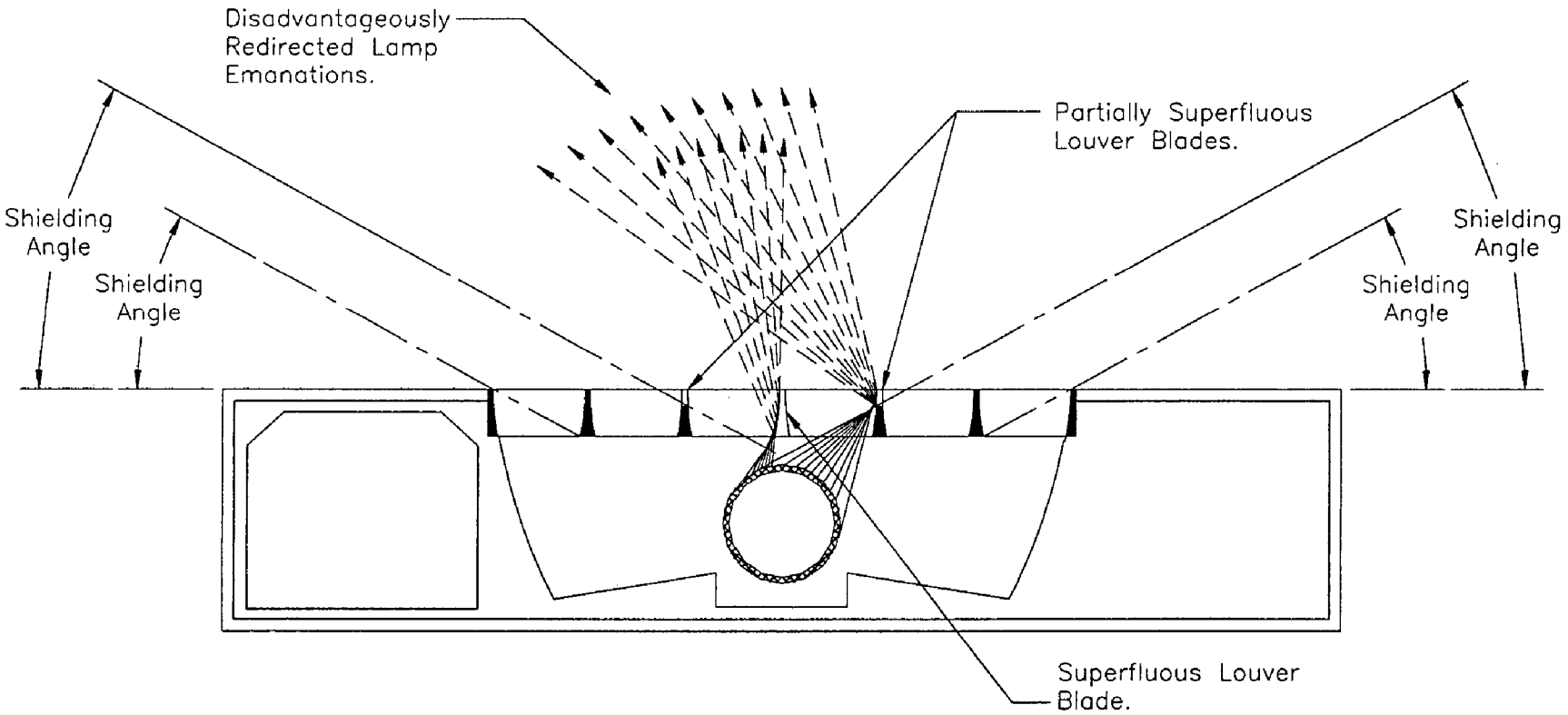
FIG. 15 (PRIOR ART)
Figure 16:
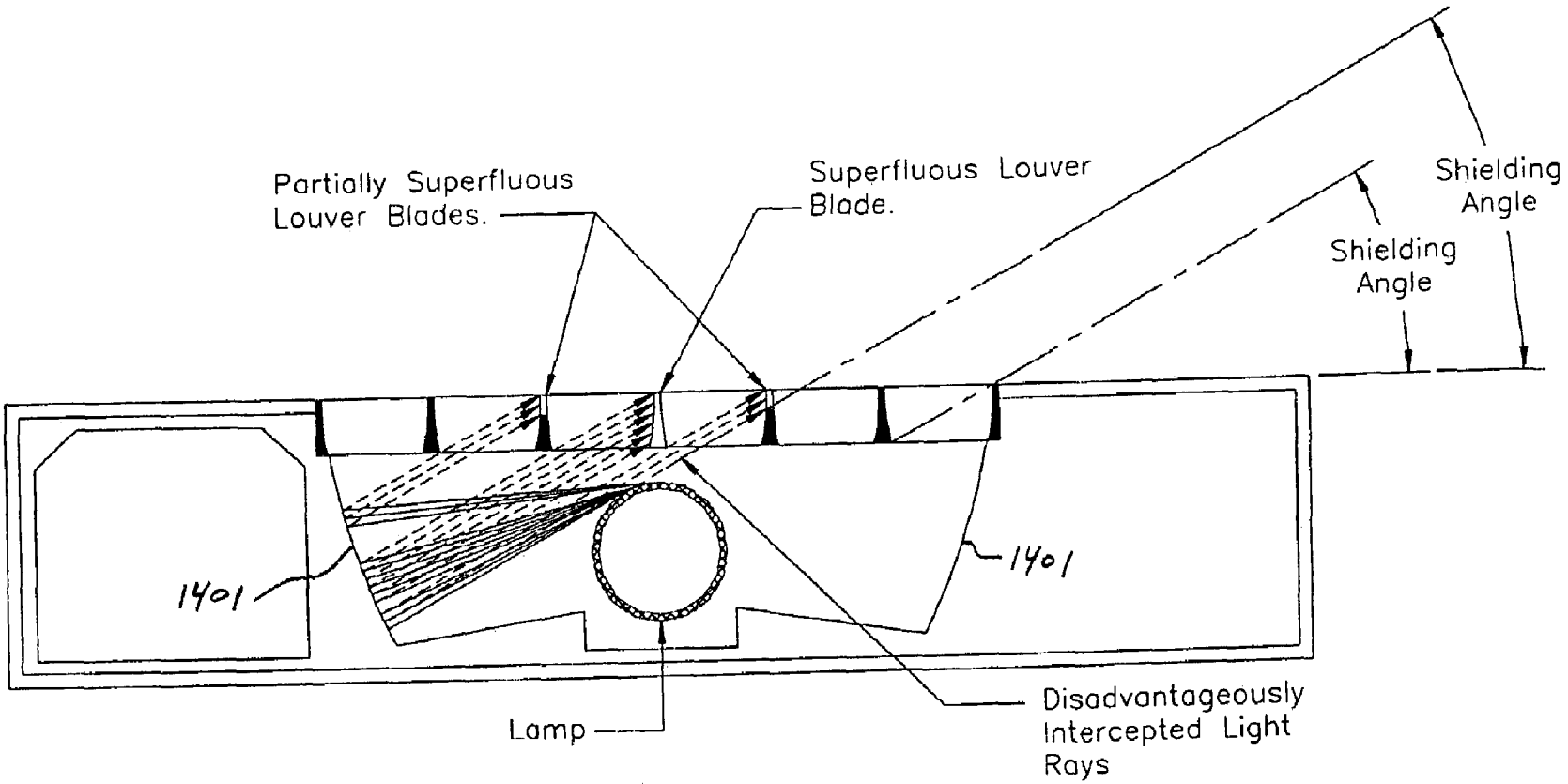
FIG. 16 PRIOR ART

FIGS. 14–16 illustrate another known uniform louver assembly that limits luminaire performance. In this embodiment, the lamp is positioned directly beneath a center longitudinal louver blade. The luminaire also includes internal reflectors 1401 that direct light rays at angles at or above the shielding angle. The uniform blade spacings again result in superfluous and/or partially superfluous louver blades. In particular, the center louver blade is entirely unnecessary. Moreover, top portions of the two longitudinal louver blades adjacent the center blade are also superfluous, because they receive only (1) direct lamp rays exiting above the shielding angle and (2) advantageously reflected light rays. Again, the interception and reflection of desirable light rays to higher angles above the shielding angle adversely affects the wide spread output of the luminaire. Furthermore, the center blade unnecessarily reduces the total open aperture area of the luminaire, adversely affecting the luminaire's efficiency (i.e., the percentage of light generated by the luminaire that is emitted from the luminaire).

Figures 17, 17X:
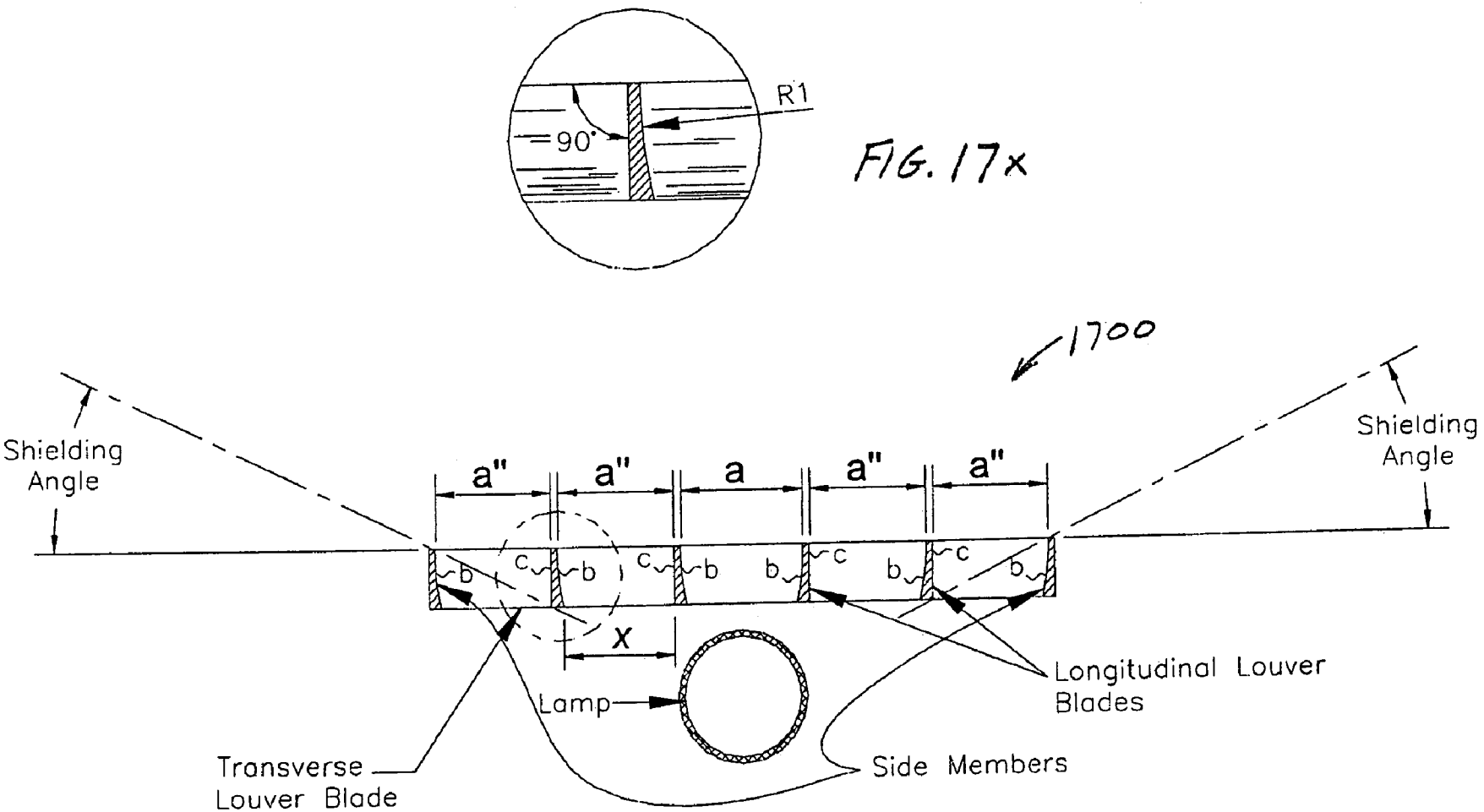
FIG. 17 is a cross-sectional view of a first embodiment of a louver assembly according to the invention.
FIG. 17*x* is an enlarged cross-sectional view of a longitudinal louver blade of the louver assembly of FIG. 17 according to the invention.

FIGS. 17 and 17*x* show an embodiment of a louver assembly in accordance with the invention. Louver assembly 1700 has longitudinal baffle blades having longitudinal inner sides b and outer sides c. Inner sides b receive direct light rays from the lamp, while outer sides c do not. As better seen in FIG. 17*x*, inner sides b and outer sides c have different curvatures (i.e., shapes, profiles, contours) in accordance with the invention. The curvature of outer sides c are such that reflected light rays incident thereon are advantageously redirected parallel to (or close to) the shielding angle. In this embodiment, outer sides c are preferably flat, planar surfaces that have a minimal effect on the angle of incident light with respect to the shielding angle. The curvature of inner sides b, in contrast, preferably has a radius R1 as shown in FIG. 17*x*. Note that longitudinal sides b and c, as well as the louver cross blades and side members, may have other curvatures than those shown. In as much as the curvature of these blade surfaces defines in part the distance x between the bottom edges of adjacent longitudinal blades (which in turn affects the transverse shielding angle), louver blade spacing a, between two inward curved blade surfaces, may be slightly greater than spacing a", which is the spacing between one flat and one curved blade side. Alternatively, louver assembly 1700 may have a uniform longitudinal blade spacing of a".

Figure 18:
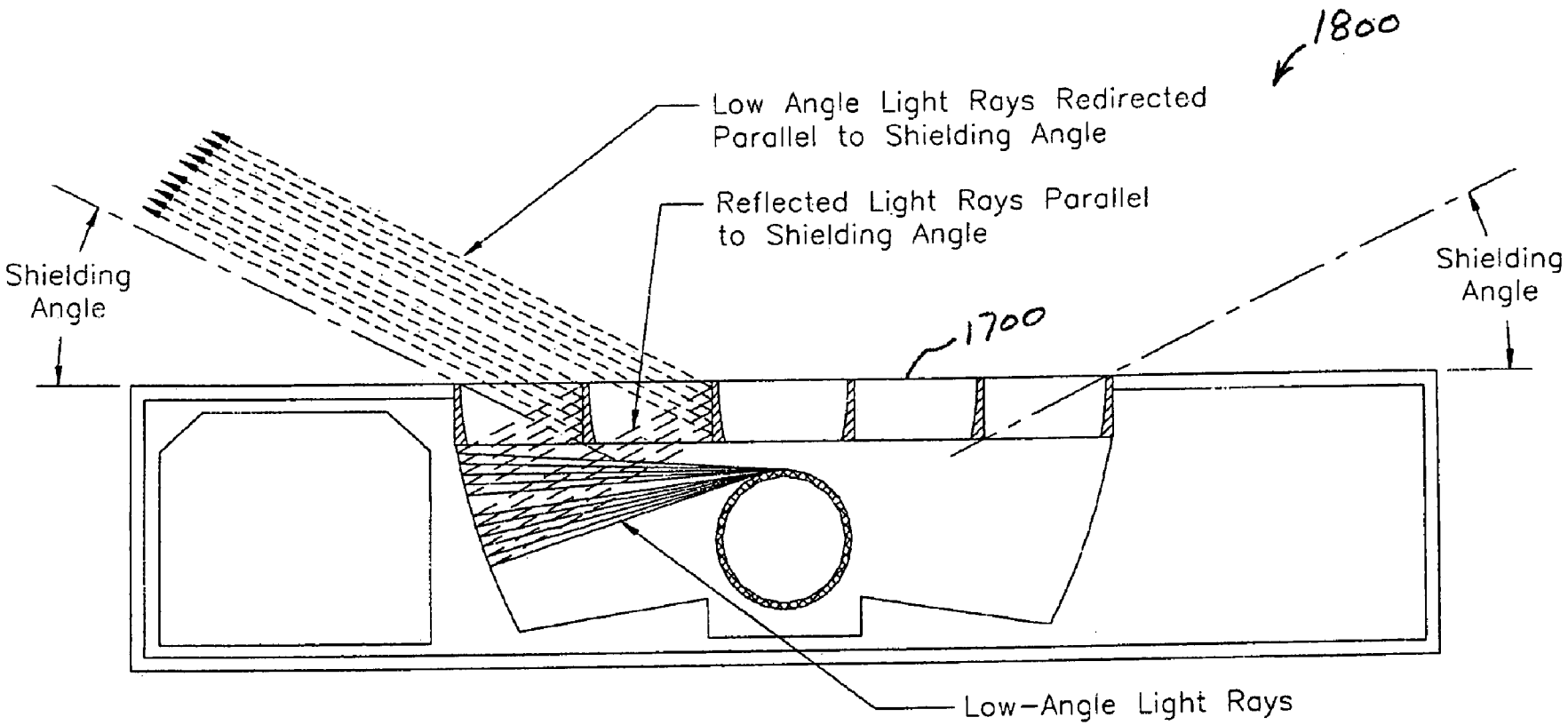
FIG. 18 is a cross-sectional view of a luminaire employing the louver assembly of FIG. 17.

FIG. 18 shows a luminaire 1800 that includes louver assembly 1700. Reflected light rays that would otherwise be redirected away from the shielding angle by known louver assemblies are instead advantageously redirected to angles close to the shielding angle in accordance with the invention.

Figure 19:
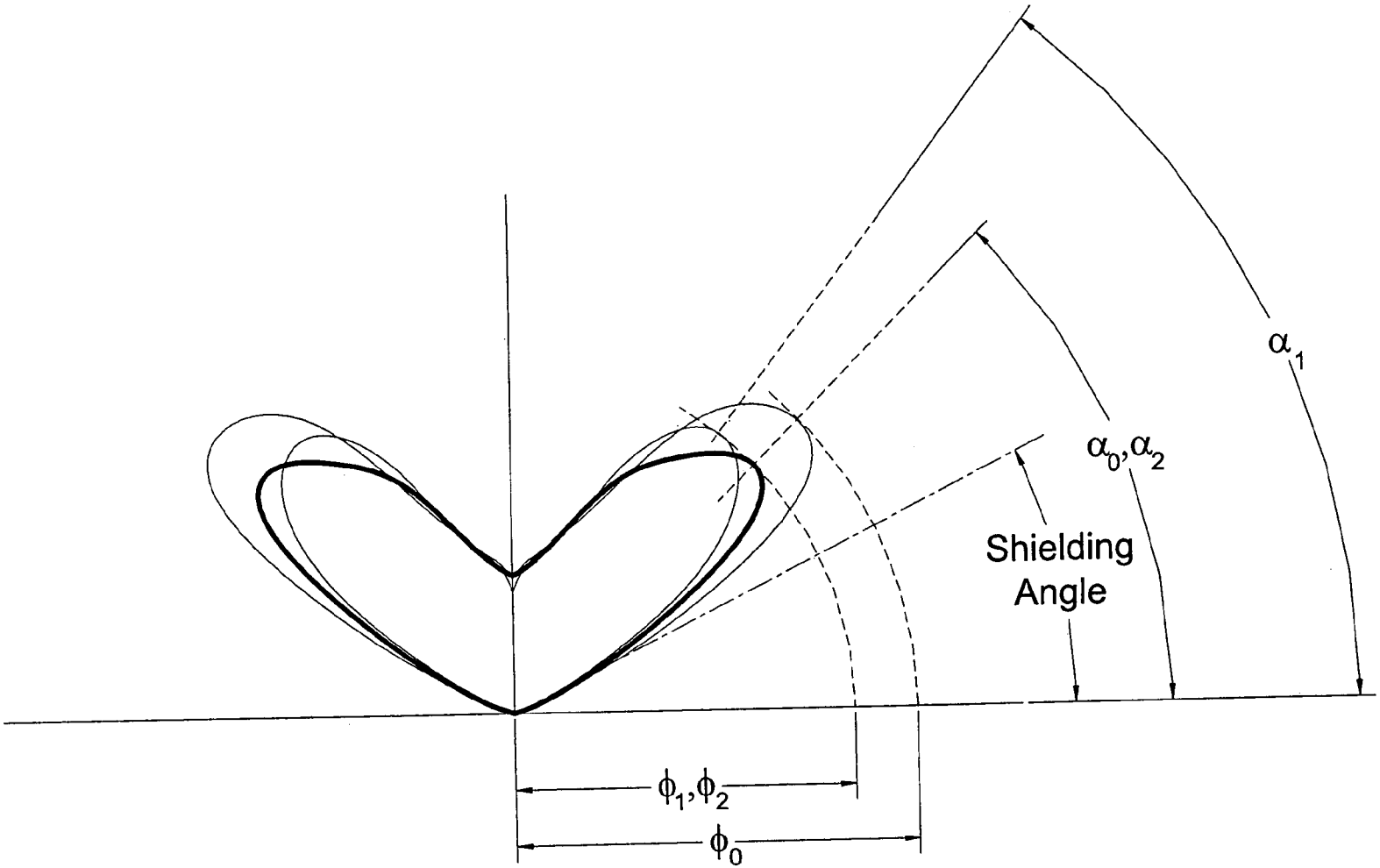
FIG. 19 is a candlepower distribution curve representing the luminous output in the transverse plane of the luminaires shown in FIGS. 4*a*, 9, and 18.

The advantageous result is shown in FIG. 19, where the performance of luminaire 1800 (shown in bold) is compared with known luminaires 400 (which has a baffle assembly) and 900 (which has a known uniform louver assembly). In particular, $\phi$1 and $\phi$2 both represent, respectively, the maximum intensity achieved with the louver of invention and known uniform louver 600 of luminaire 900 (FIG. 9). $\phi$0 represents the maximum intensity achieved with the baffle assembly of luminaire 400 (FIG. 4*a*). Angle $\alpha$2 is the angle of maximum intensity produced by the louver of the invention, and the shielding angle again is 26°. Angles $\alpha$0 and $\alpha$1 are the angles of maximum intensity for luminaires 400 and 900, respectively. Advantageously, the louver of invention achieves a distribution where the angle of maximum intensity (angle $\alpha$2, which is 44°) is 30% closer to the shielding angle than angle $\alpha$1 achieved by known uniform louver assembly 600. Accordingly, angle $\alpha$2 is equal to that achieved by the baffle assembly (see angle $\alpha$0). Also significant is that the intensity ($\phi$2) achieved at angle $\alpha$2 is about 7% greater than that achieved by known uniform louver 600 at the same angle. More significant is that the louver of the invention achieves a 20% increase in output at an angle just 10° above the shielding angle when compared with that of known uniform louver 600.

Although luminaire efficiency and maximum intensity is essentially unchanged by the louver of the invention when compared with known uniform louver assembly 600 of luminaire 900, the resulting wide spread distribution achieves greater uniformity of surface (e.g., ceiling) brightness and greater visual comfort, particularly in furniture/partition mounted luminaires.

Figure 20A:
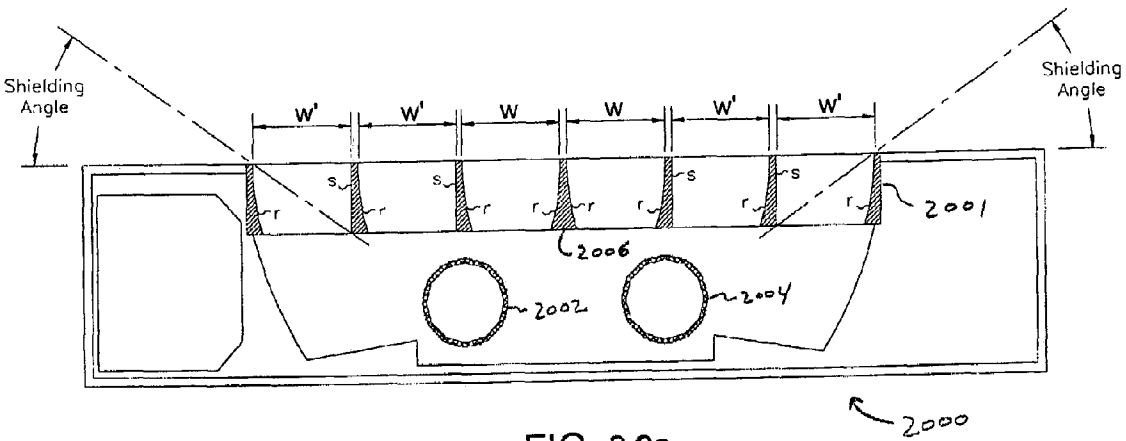
FIGS. 20*a,b* are cross-sectional views of another embodiment of a louver assembly according to the invention.
Figure 20B:
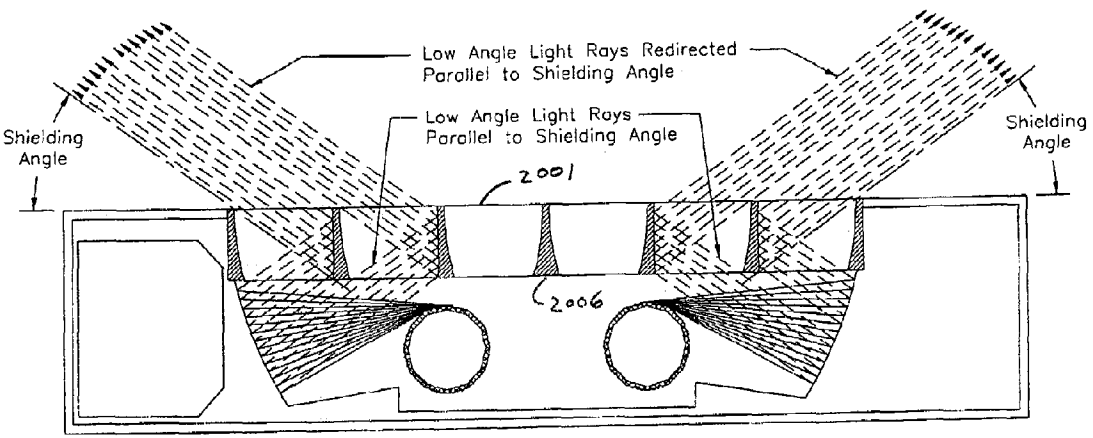

FIGS. 20*a,b* illustrate another embodiment of a louver assembly in accordance with the invention. Louver assembly 2001 is incorporated in a luminaire 2000 employing two parallel elongated lamps 2002 and 2004. Center longitudinal louver blade 2006 has two identically curved sides, while the other longitudinal louver blades have one planar and one curved side each. Two of these other longitudinal louver blades occur directly over the lamps. While the flat sides of these two blades receive some direct lamp emanations from the respective lamp immediately below them, they receive no direct light rays from the respective other lamp, and their direct exposure is limited to high angle light rays that are redirected above the shielding angle. FIG. 20*b* illustrates the advantageous redirection of light rays parallel to the shielding angle, which results in a wide spread distribution.

Figure 21A:
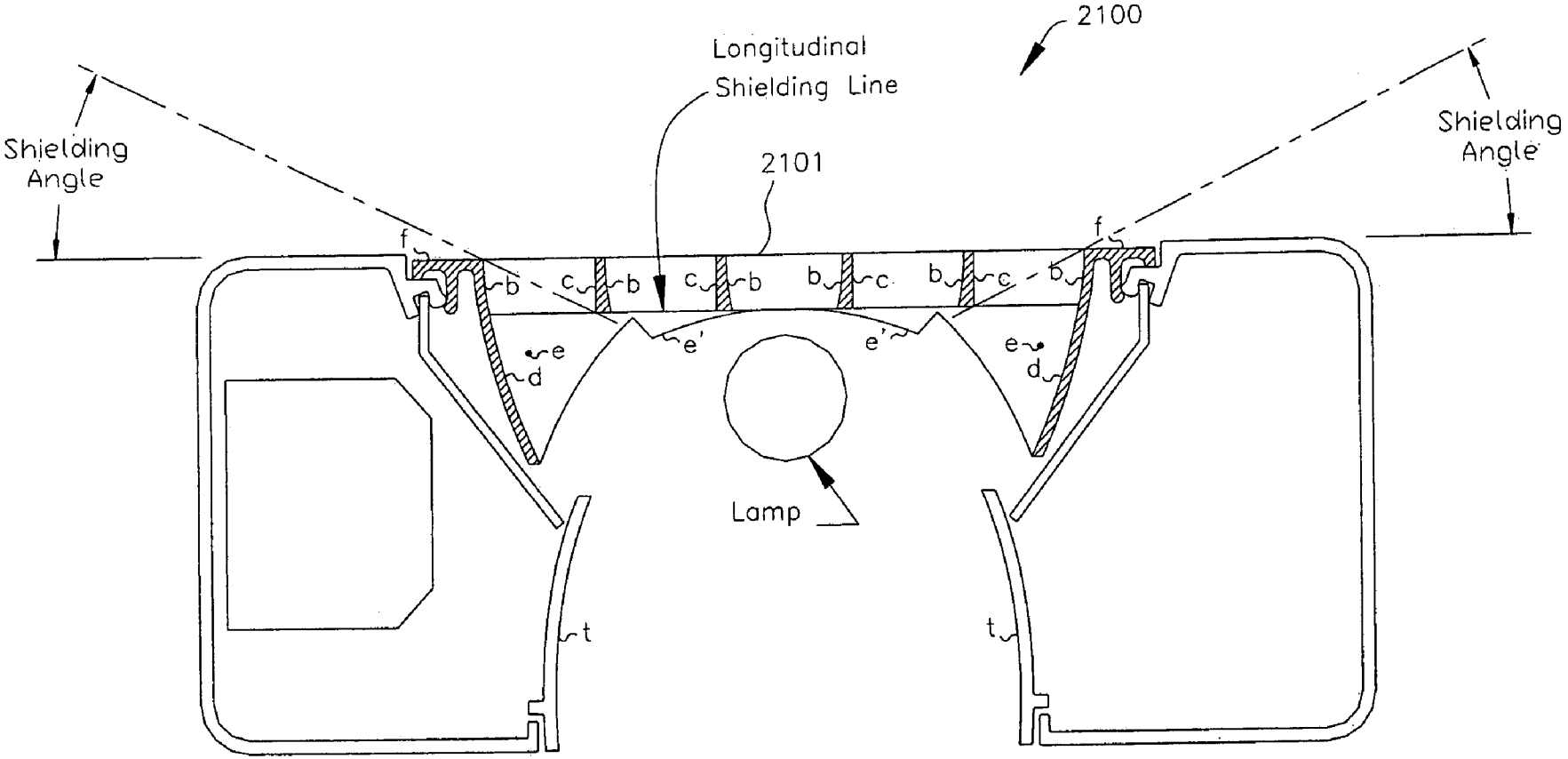
FIGS. 21*a,b* are cross-sectional and partial perspective views, respectively, of another embodiment of a louver assembly according to the invention.
Figure 21B:
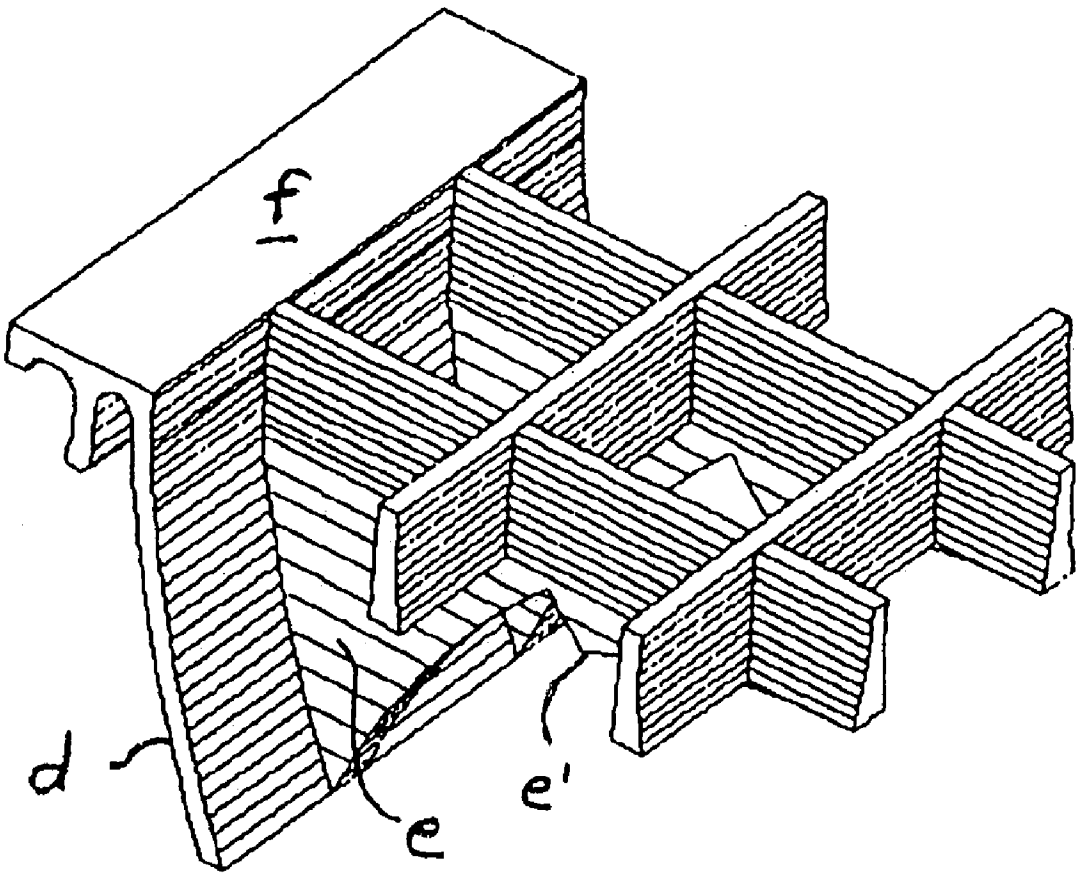

FIGS. 21*a,b* illustrate another embodiment of a louver assembly in accordance with the invention. Louver assembly 2101 is positioned in the top aperture of a direct/indirect luminaire 2100. Louver assembly 2101 establishes shielding for sightlines originating above the luminaire. In this embodiment, the shielding angle is again 26° (other angles are, of course, possible) and the angle of maximum uptight intensity provided by louver 2101 advantageously occurs within 15° of the shielding angle. The louver is formed with extended side members that integrate additional reflector segments d into the assemblies. The louver also includes horizontal top extensions f that facilitate mounting. The louver further has cross-blade fillets e that facilitate production when the extended side members are formed by injection molding. Cross-blade extensions e' allow the transverse blades to be uniquely fashioned below the longitudinal shielding line to divert light rays that otherwise would be disadvantageously redirected by the bottom surfaces of the blades toward the downlight reflectors t.

Figure 22:
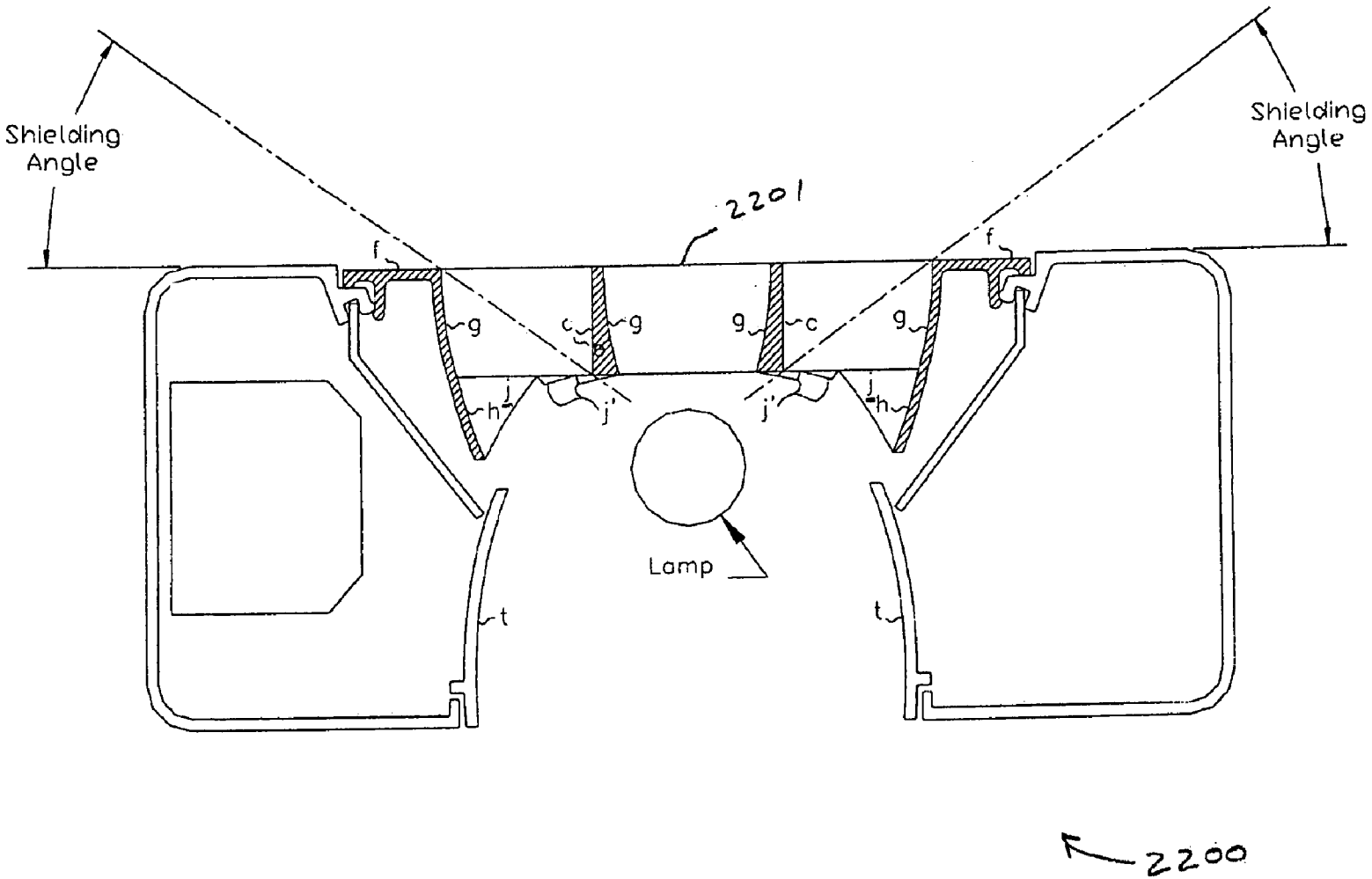
FIG. 22 is a cross-sectional view of still another embodiment of a louver assembly according to the invention.

FIG. 22 illustrates still another embodiment of a louver assembly in accordance with the invention. Louver assembly 2201 is positioned in the top aperture of a direct/indirect luminaire. Louver 2201 is fashioned and positioned in luminaire 2200 for a lamp position different than that of luminaire 2100 and for providing a shielding angle of 35° instead of 26°. Again, the louver is formed with extended side members that integrate additional reflector segments h into the assemblies. Louver 2201 also includes horizontal top extensions f that facilitate mounting. Cross-blade fillets j facilitate one-piece molding techniques, and cross-blade extensions j' control the angle of light rays reflected from the bottom surfaces of the cross-blades. Advantageously, the angle of maximum uplight intensity again occurs within 15° of the shielding angle.

FIG. 23 again shows louver assembly 1700 positioned in luminaire 1800 (from FIG. 18). Louver assembly 1700 has substantially uniform longitudinal louver blade spacings and uniform blade heights. And while the wide spread distribution of luminaire 1800 is improved by louver 1700 having longitudinal blades with different longitudinal side curvatures, the performance of luminaire 1800 can be further improved by modifying louver 1700 in accordance with the invention.

Figure 23:
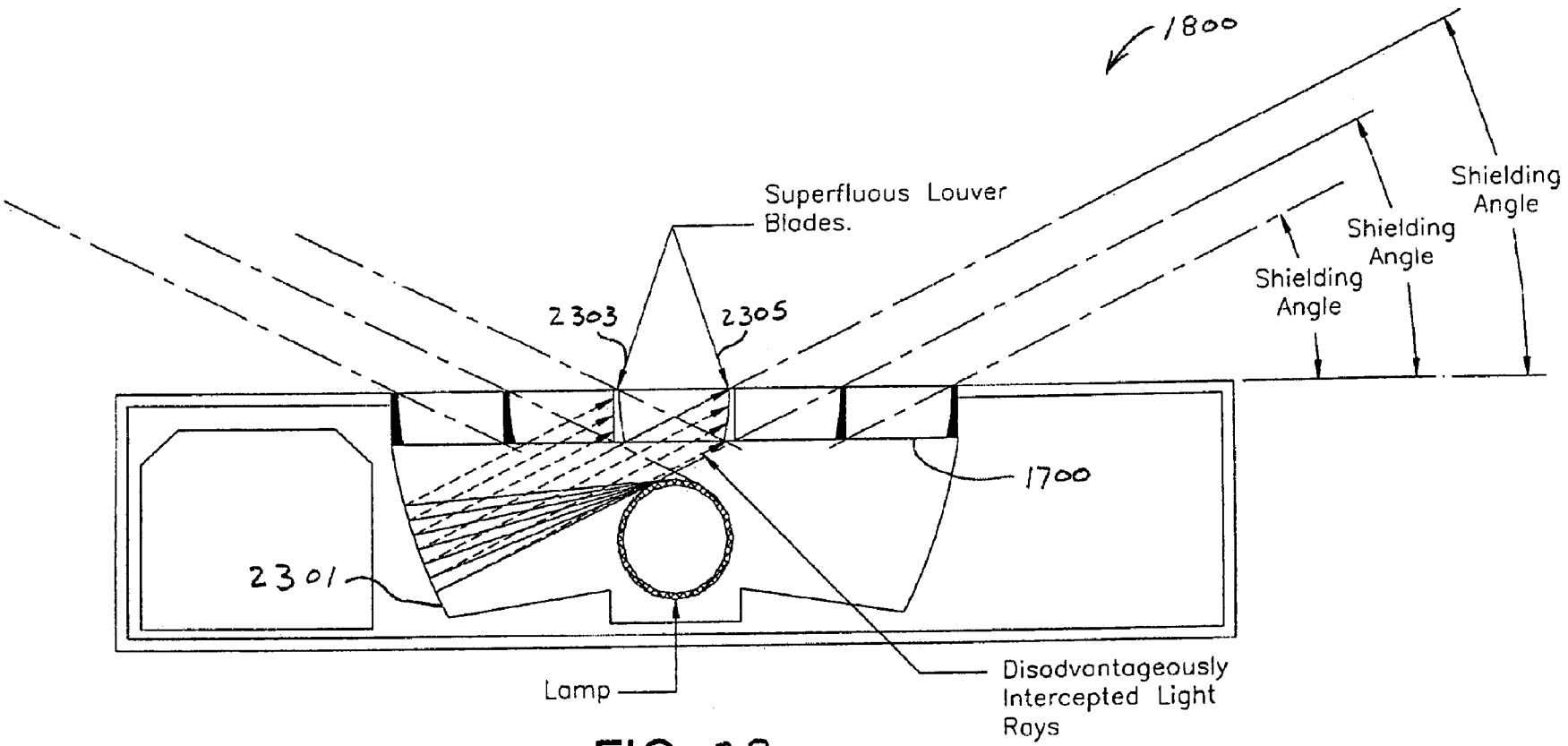
FIG. 23 is a cross-sectional view of the luminaire of FIG. 18 showing disadvantageous interception of advantageously reflected light rays.

As shown in FIG. 23, reflector 2301 advantageously redirects light rays at angles above and preferably parallel to the shielding angle. Note that the two center longitudinal louver blades 2303 and 2305 (shown unshaded) unnecessarily intercept those desirable light rays. And although the planar side of louver blade 2303 will redirect in a desirable direction the light rays striking it (see FIG. 18), recall that each reflectance of light striking a louver blade loses about 10% to 15% of that light. This adversely affects luminaire efficiency. Moreover, the light shown striking louver blade 2305 will be redirected at an undesirably higher angle. The same is true for light striking louver blades 2303 and 2305 from the right side of luminaire 1800 (not shown).

Figure 24:
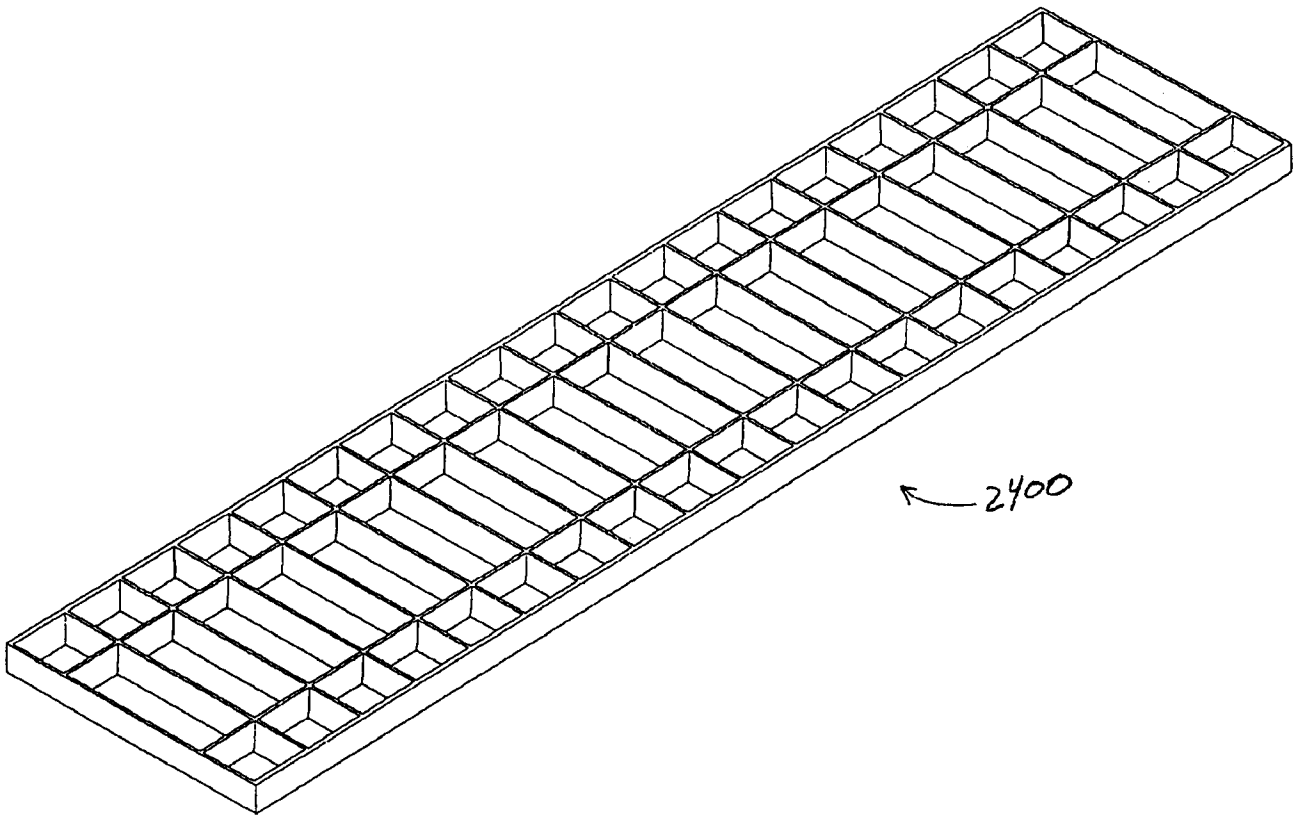
FIGS. 24 and 25 are perspective and cross-sectional views, respectively, of another embodiment of a louver assembly according to the invention.
Figure 25:
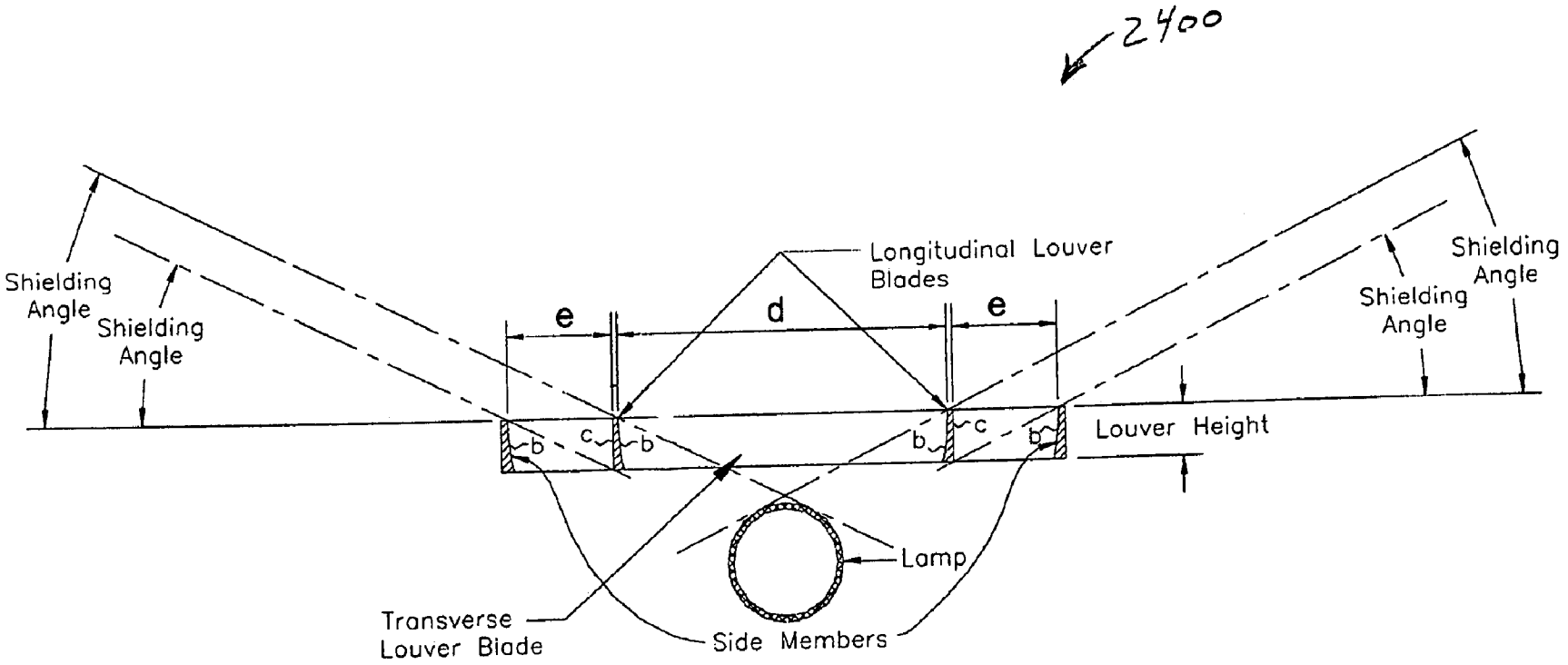

Therefore, in accordance with the invention, a further improved louver assembly is shown in FIGS. 24 and 25. Louver assembly 2400 is similar to louver 1700 except that the superfluous center longitudinal blades are omitted. The apertures of louver 2400 are thus of non-uniform size. Larger apertures are found over the lamps, thus allowing more light to exit the luminaire, improving efficiency, while smaller apertures are transversely adjacent the larger apertures (note transverse widths e and d in FIG. 25). In particular, transverse width d is greater than transverse widths e.

The longitudinal blades of louver 2400 preferably have longitudinal sides with different curvatures b and c as shown. In this embodiment, curvature b is preferably parabolic, while curvature c is preferably planar. Alternatively, other curvatures may be used, and they need not be different from each other (although some benefit may be lost depending on the angles at which those curvatures redirect light).

Figure 26:
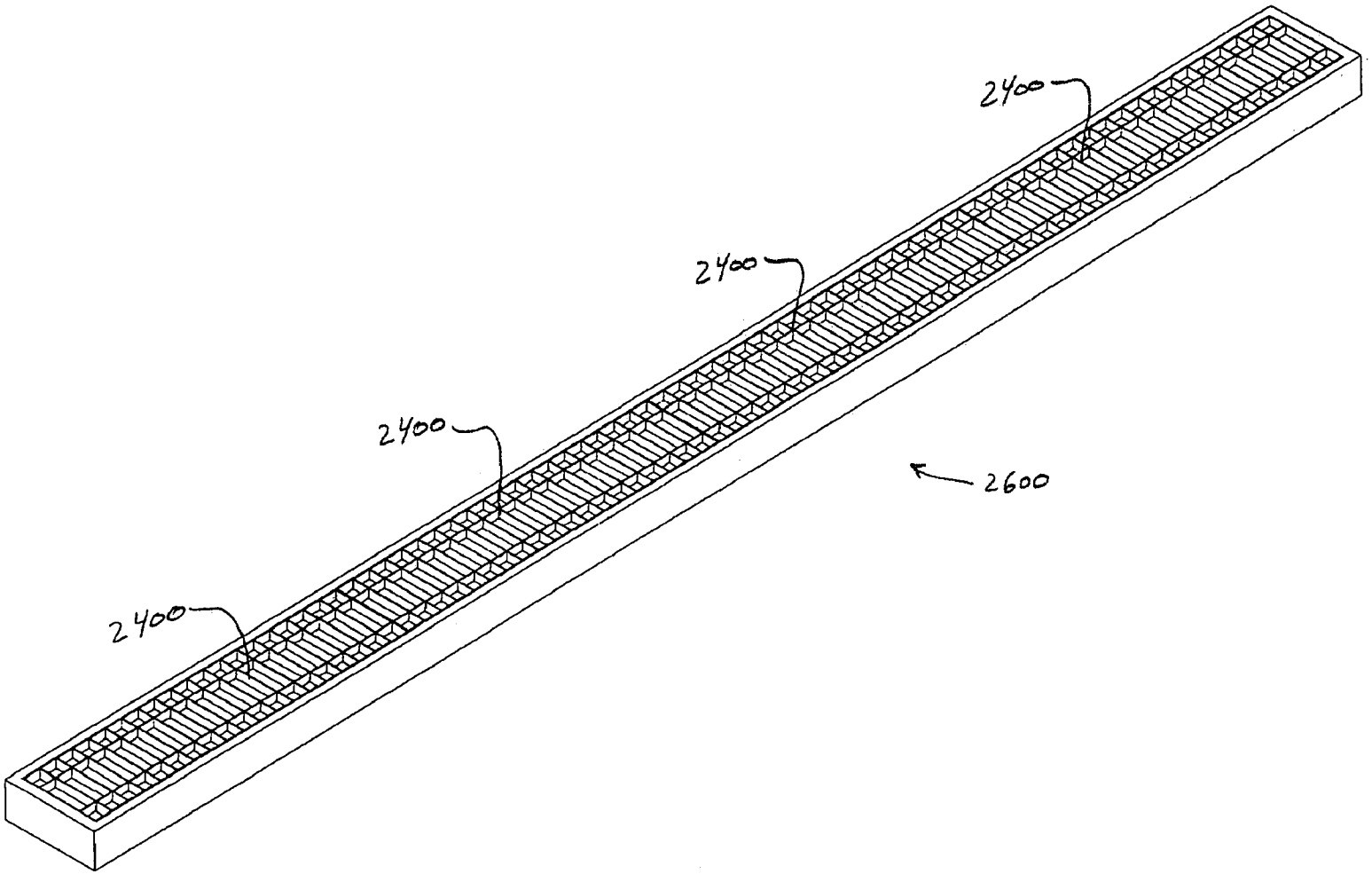
FIG. 26 is a perspective view of a luminaire employing several louvers of FIGS. 24 and 25.
Figure 27:
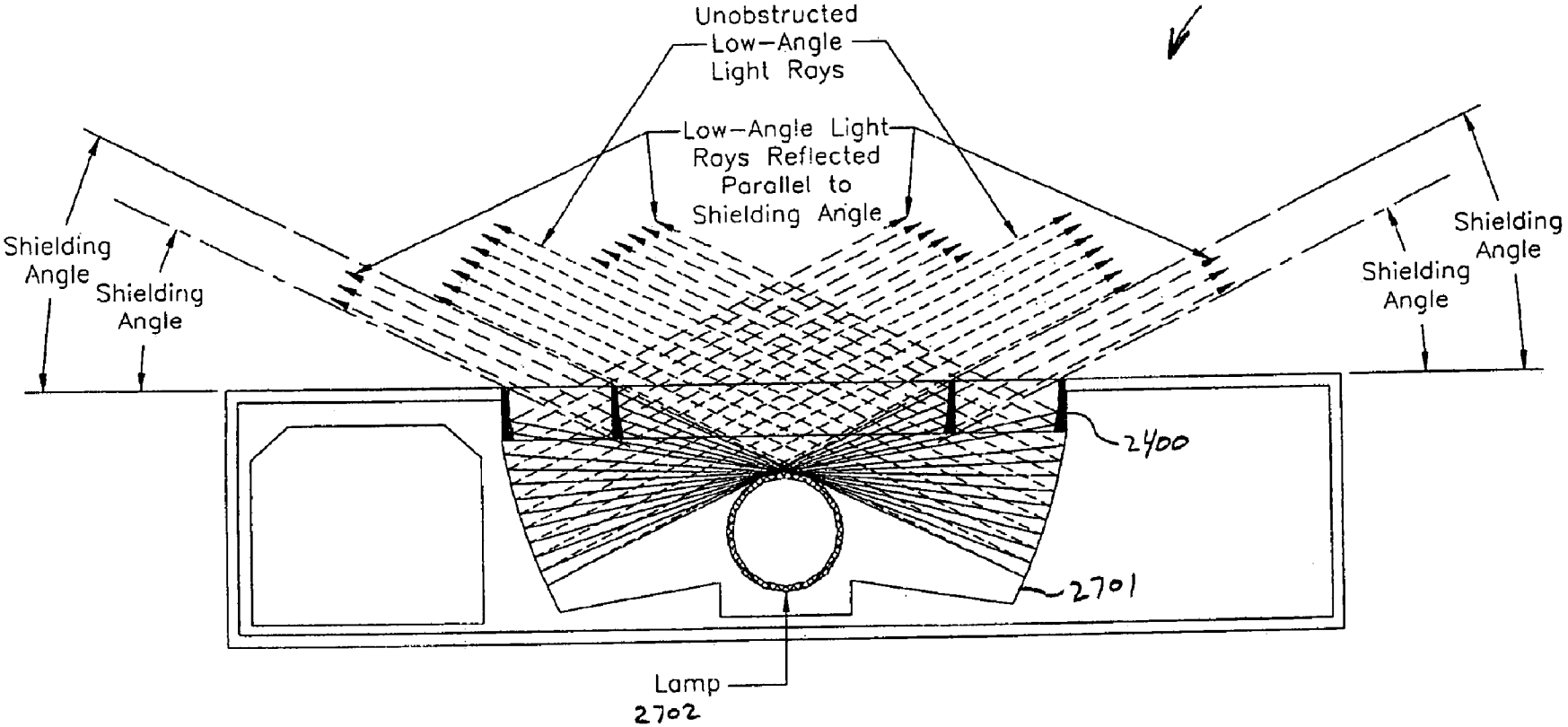
FIG. 27 is a cross-sectional view of another luminaire employing the louver of FIGS. 24 and 25 in which unobstructed and advantageously redirected light rays are shown exiting the luminaire.

FIGS. 26 and 27 show luminaires incorporating louver 2400. Luminaire 2600 includes several louver assemblies 2400. FIG. 27 shows large numbers of reflected light rays that are advantageously no longer intercepted and redirected away from the shielding angle, thus improving both efficiency and the wide spread distribution pattern. Moreover, the longitudinal blades advantageously redirect the direct emanations from lamp 2702 and the reflected light from reflector 2701 at low angles parallel to the shielding angle.

Figure 28:
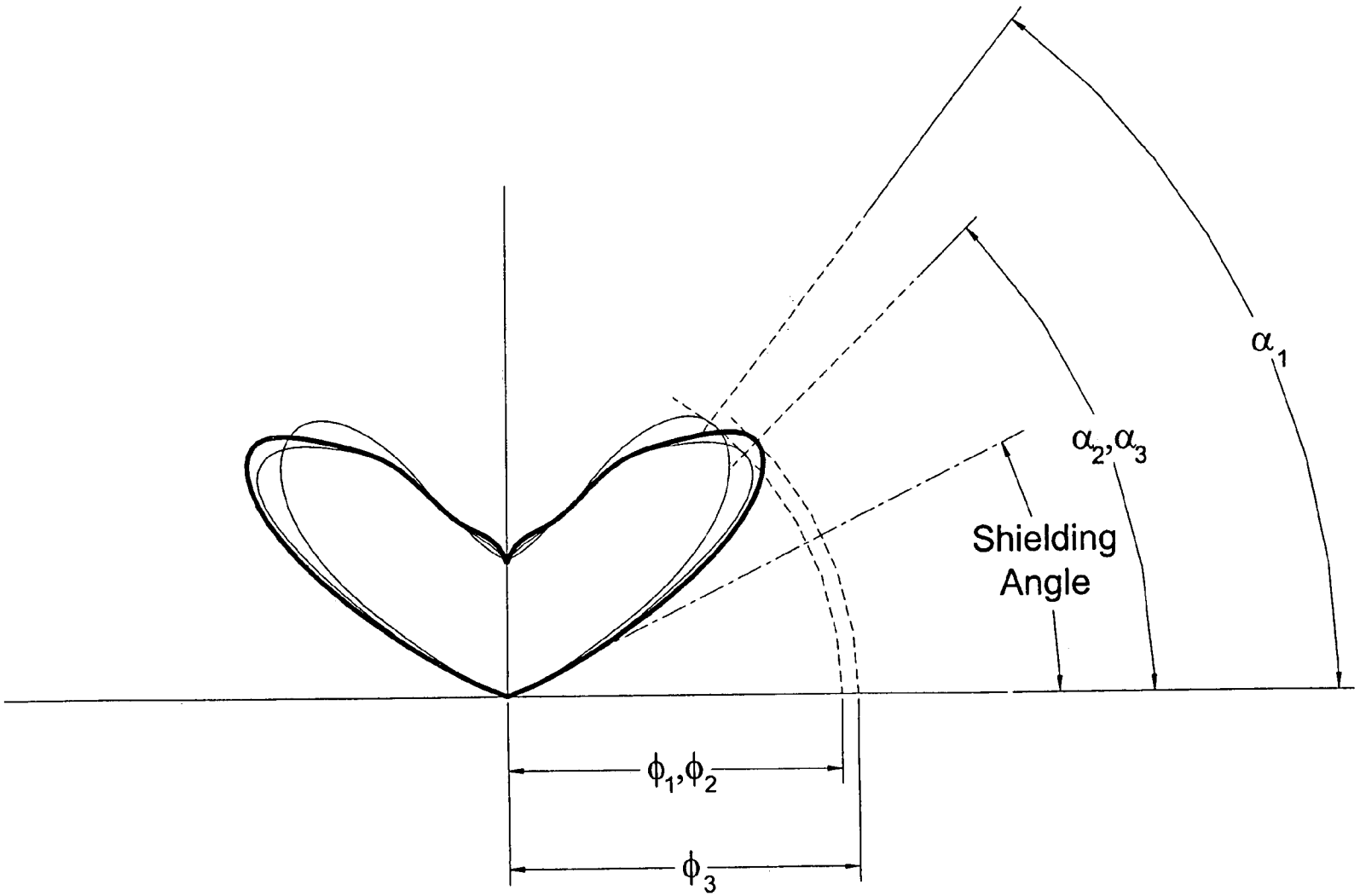
FIG. 28 is a candlepower distribution curve representing the luminous output in the transverse plane of the luminaires shown in FIGS. 9, 18, and 27.
Figure 29:
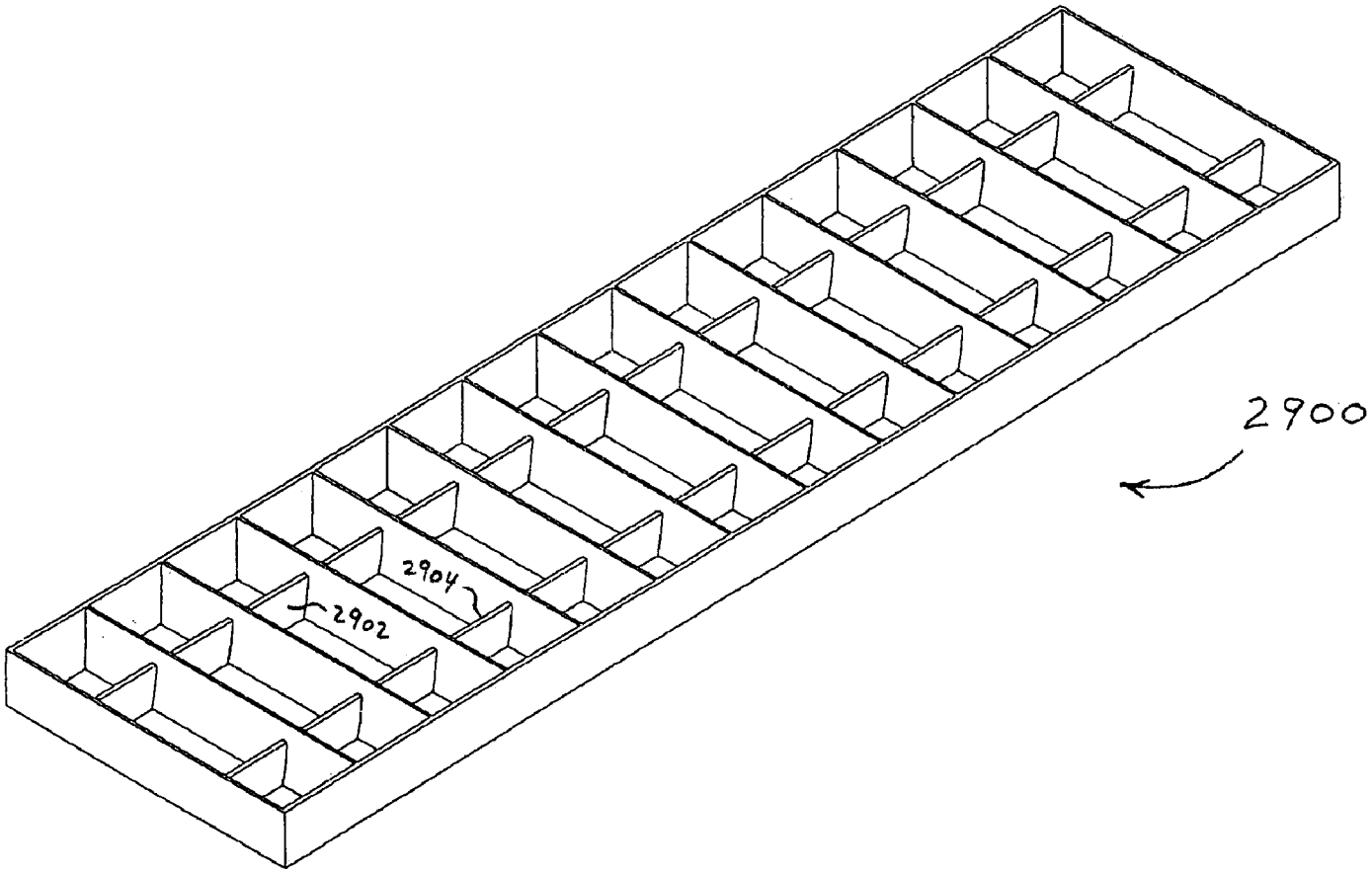
FIGS. 29 and 30 are perspective and cross-sectional views, respectively, of another embodiment of a louver assembly according to the invention.
Figures 30, 30X:
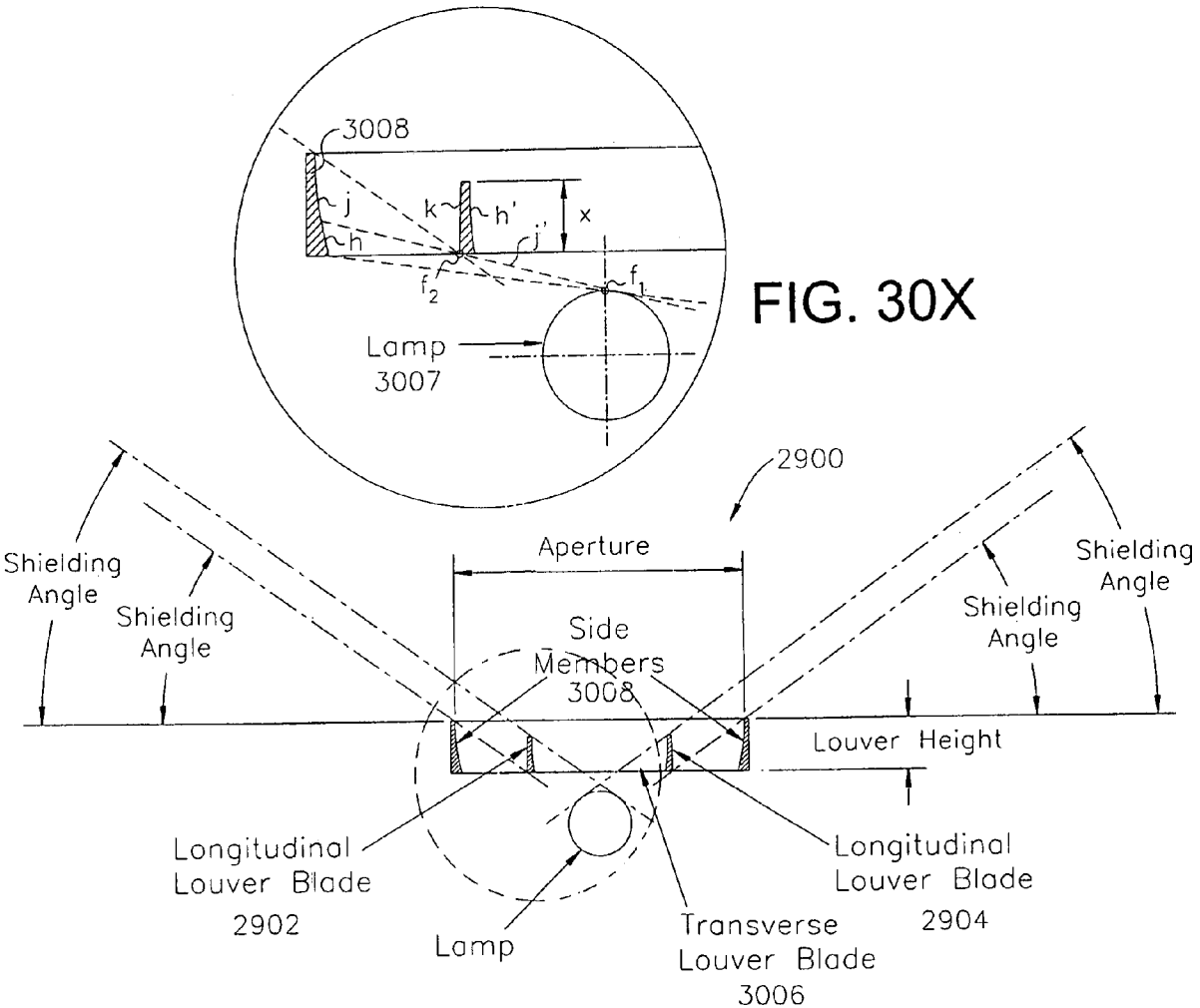
FIG. 30*x* is an enlarged cross-sectional view of a portion of the louver assembly of FIGS. 29 and 30.

These advantageous results are shown in FIG. 28, where the performance (shown in bold) of louver 2400 in luminaire 2700 is compared with that of the louvers in luminaires 900 and 1800 of FIGS. 9 and 18, respectively. In particular, louver 2400 results in a maximum intensity of $\phi$3 and an angle of maximum intensity $\alpha$3. The shielding angle again is 26°. Louver 2400 achieves a distribution where the angle of maximum intensity closely approximates that achieved by louver assembly 1700 (i.e., the louver with strategically shaped longitudinal blades). However, the maximum intensity $\phi$3 achieved at angle $\alpha$3 is 5% greater than that achieved by louver 1700 and is about 12% greater than that achieved by known uniform louver assembly 600 at the same angle. Maximum intensity $\phi$3 is accordingly also about 5% greater than the maximum intensity achieved by louver assembly 600 at any angle (recall that $\phi$1 approximates $\phi$2). More significantly, louver 2400 achieves a 28% increase in output at an angle just 10° above the shielding angle when compared to known uniform louver assembly 600. The resulting wide spread distribution achieves greater uniformity of surface (e.g., ceiling) brightness and greater visual comfort than that possible with known louvers, particularly in furniture/partition mounted luminaires.

Figure 31:
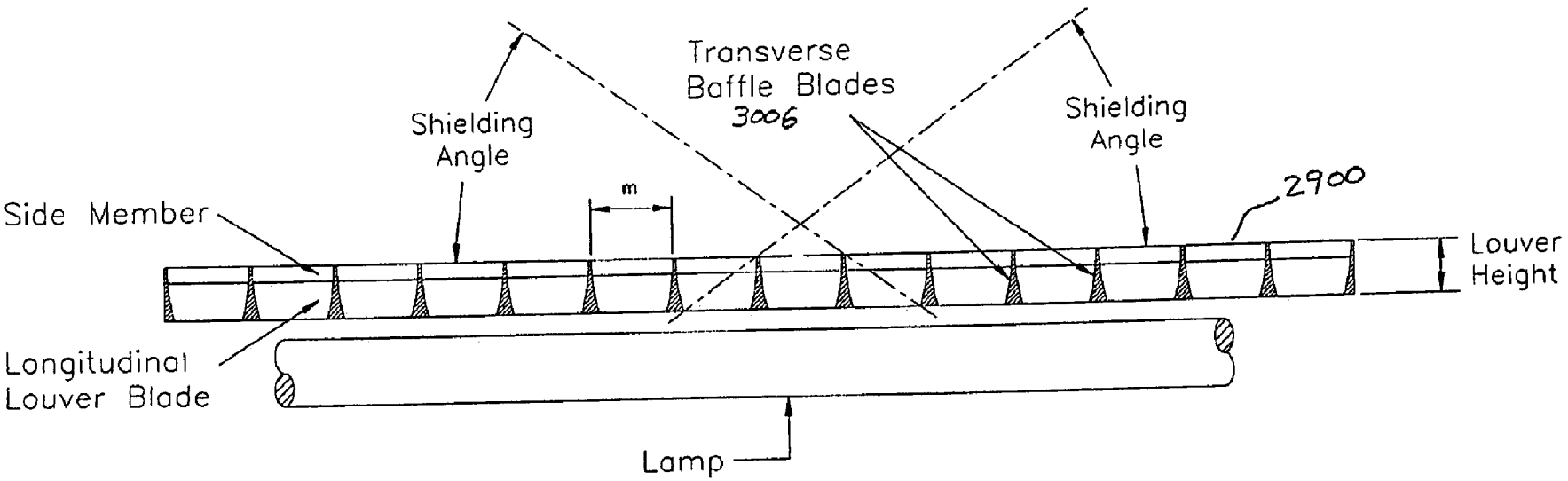
FIG. 31 is a partial longitudinal view of the louver assembly of FIGS. 29 and 30.

FIGS. 29–33 show another embodiment of a louver assembly in accordance with the invention. Louver 2900 has two interior longitudinal louver blades 2902 and 2904 that each have a height less than that of the louver side members and cross (transverse) blades. In other words, the tops of the longitudinal blades are non planar with the tops of the side members and cross blades, where "top" is defined as the side farthest from the luminaire lamp(s). Louver blades 2902 and 2904 preferably have longitudinal sides of different curvatures (e.g., curvatures k and h' as shown in FIG. 30*x*, which may be planar and parabolic, respectively), and cross blades 3006 are preferably uniformly spaced by a distance m (FIG. 31). In one embodiment of the invention, the inner (lamp facing) side of louver side members 3008 (FIGS. 30 and 30*x*) preferably have a surface curvature formed by two parabolic shapes h and j that have a common edge coincident with line j'. Line j' passes through point f2 and is tangent to the top of lamp 3007. Specifically, shapes h and j have focal points f1 and f2, respectively, that are coincident with the lowest angle direct lamp rays incident to the respective shapes. Shapes h and j advantageously redirect these lamp rays (and all other light rays passing through the respective focal points) parallel to the shielding angle. Note that the longitudinal blades, as well as the side members, are not limited to having one shape per longitudinal side, but alternatively can have multiple shapes per longitudinal side.

Figure 32:
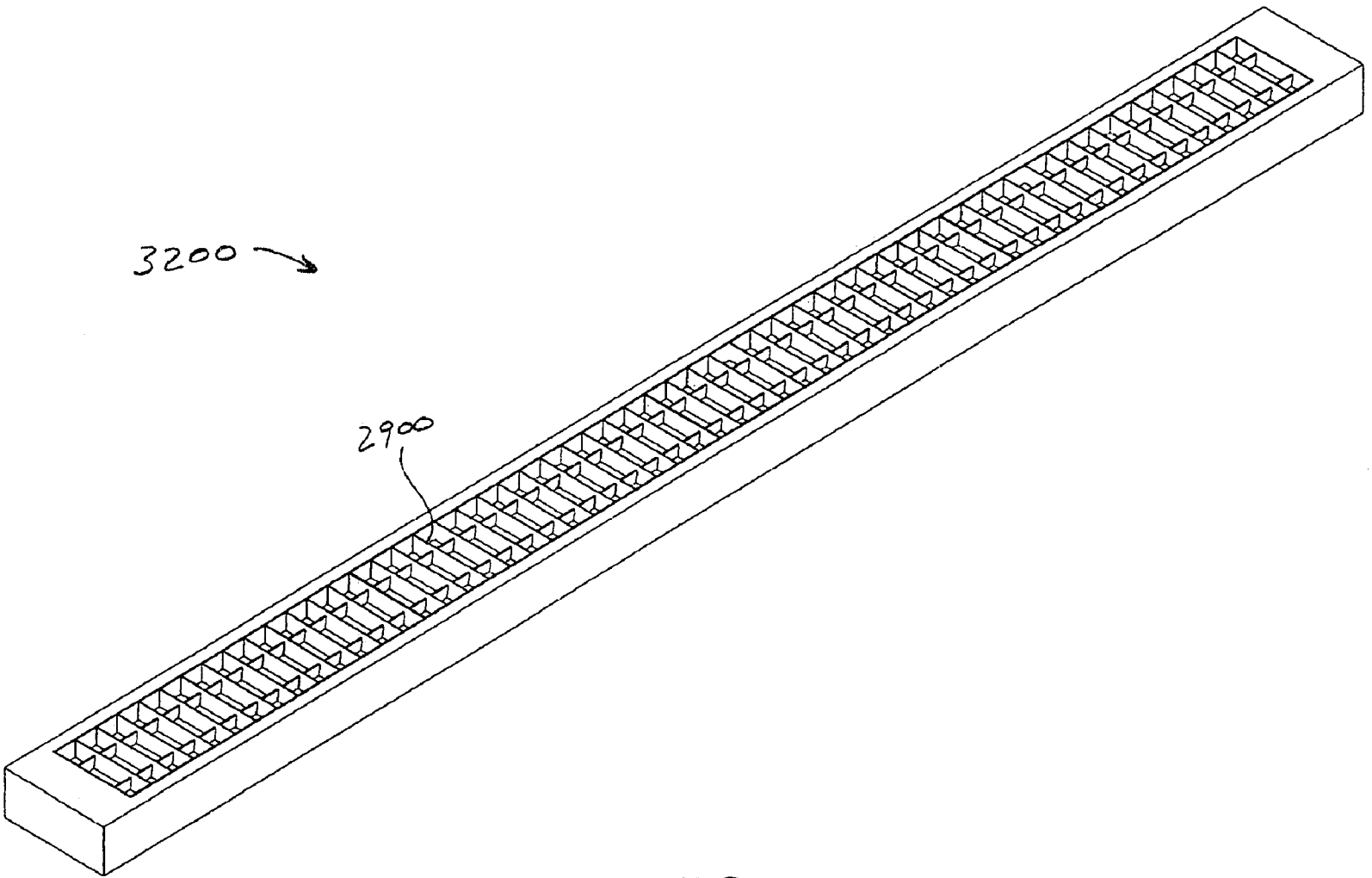
FIG. 32 is a perspective view of a luminaire employing the louver assembly of FIGS. 29–31.
Figure 33:
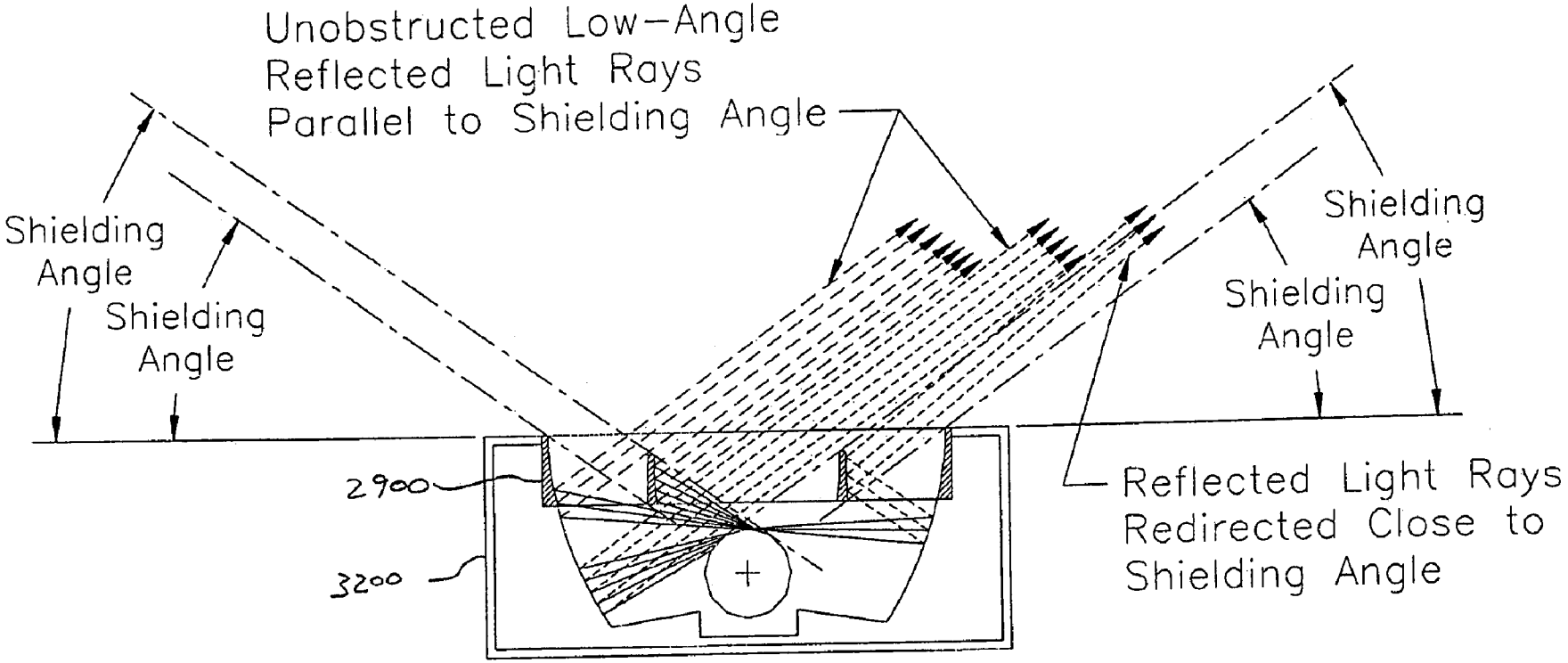
FIG. 33 is a cross-sectional view of the luminaire of FIG. 32 showing unobstructed and advantageously redirected light rays exiting the luminaire.

FIGS. 32 and 33 show luminaire 3200 fitted with louver assembly 2900. Louver 2900 reduces the obstruction and disadvantageous redirection of light rays exiting the luminaire near the shielding angle. Moreover, louver 2900 advantageously redirects obstructed rays to angles close to the shielding angle, thus achieving high luminaire efficiency and a wide spread distribution. Note that the overall aperture width of the louver relative to the shielding angle, louver height, and location of the lamp determines the height x (see FIG. 30*x*) of louver blades 2902 and 2904.

Figure 34A:
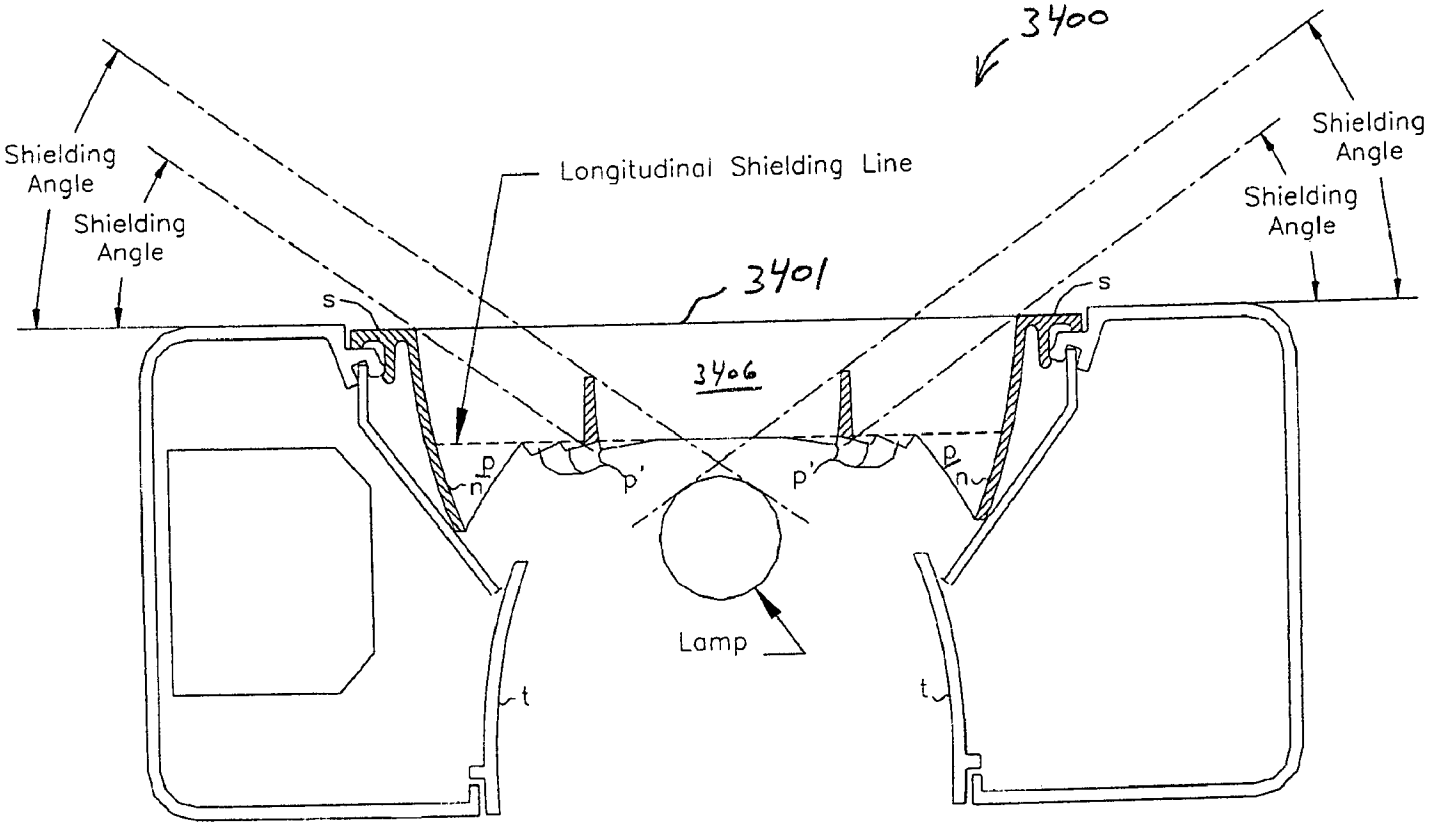
FIGS. 34*a,b* are cross-sectional and partial perspective views, respectively, of another embodiment of a louver assembly according to the invention.
Figure 34B:
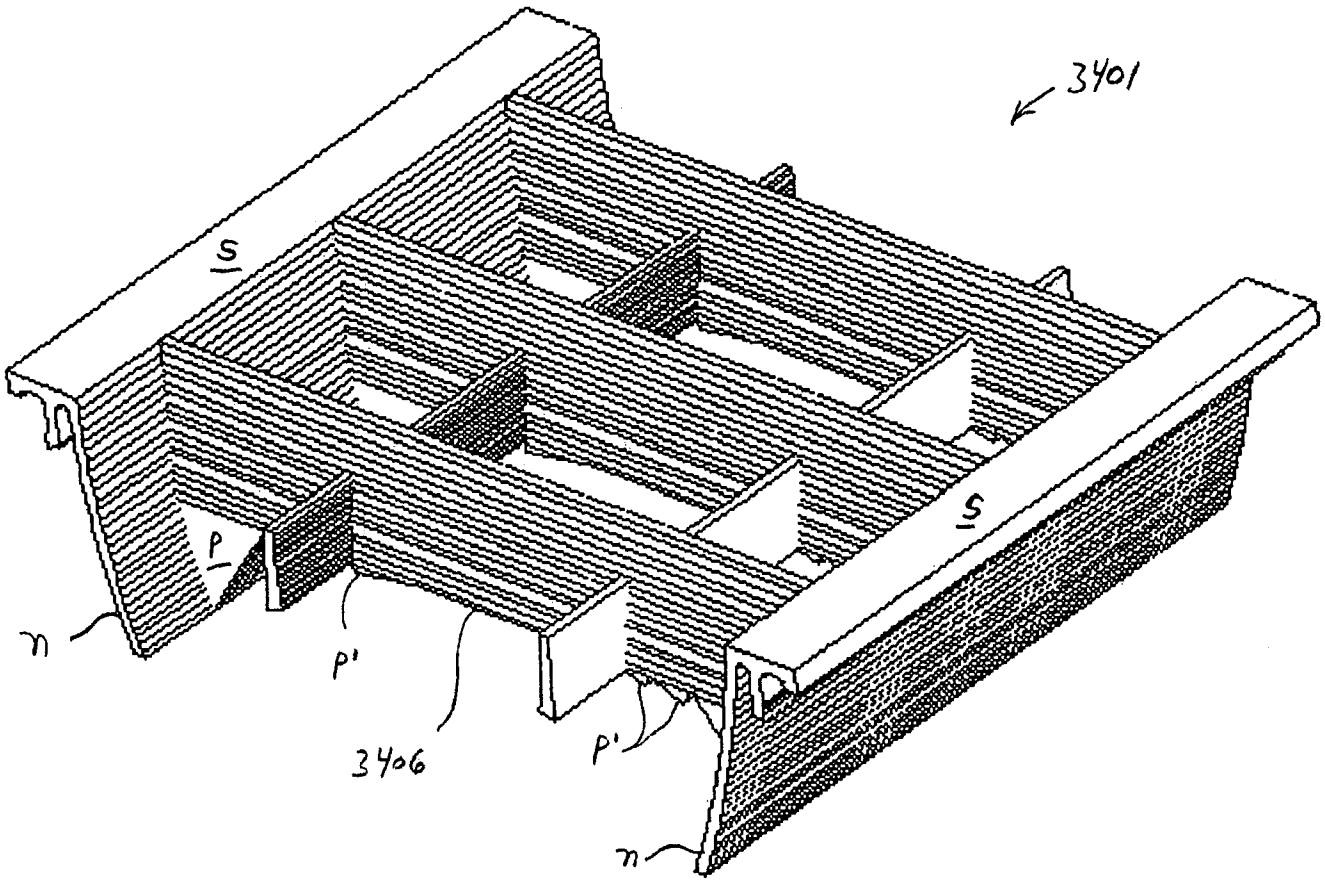

FIGS. 34*a,b* show another embodiment of a louver assembly in accordance with the invention. Louver assembly 3401 is positioned in the top aperture of a direct/indirect luminaire 3400. Louver 3401 establishes shielding for sightlines originating above luminaire 3400. The tops of the longitudinal blades are nonplanar with the tops of the side members and cross blades. The longitudinal blades preferably have longitudinal sides with different curvatures as described above. In this embodiment, the shielding angle is 35°, and the louver is formed with extended side members that advantageously integrate additional reflector segments n into the assemblies. Horizontal top extensions s advantageously facilitate mounting of the louver in a luminaire. Cross-blade fillets p facilitate production when louver 3401 is formed by injection molding, and cross-blade extensions p' allow transverse blades 3406 to be uniquely fashioned below the longitudinal shielding line to divert light rays that otherwise would be disadvantageously redirected by the bottom surfaces of the blades toward downlight reflectors t. Louver 3401 advantageously produces an angle of maximum uptight intensity that occurs within 15° of the shielding angle.

Figure 35A:
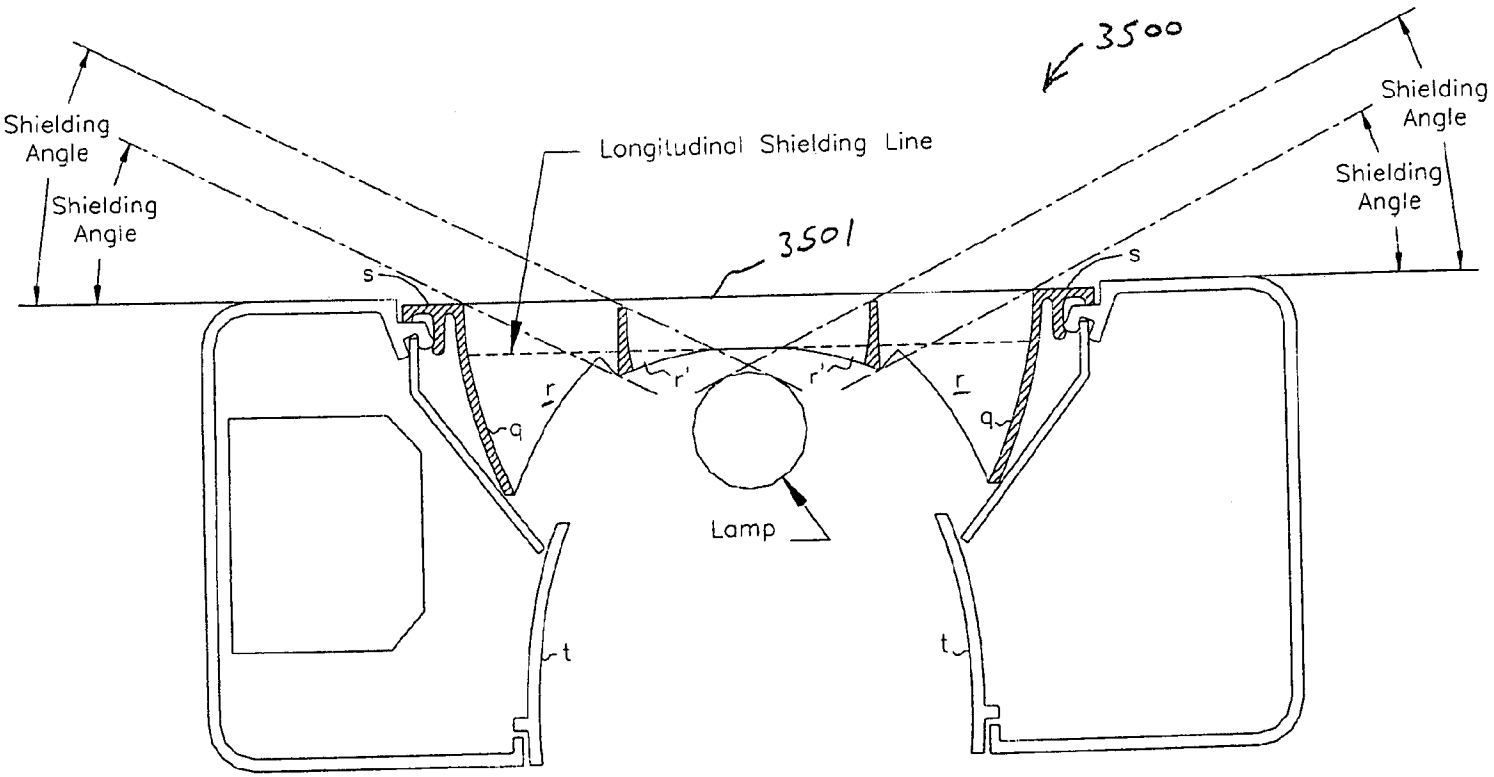
FIGS. 35*a,b* are cross-sectional and partial perspective views, respectively, of still another embodiment of a louver assembly according to the invention.
Figure 35B:
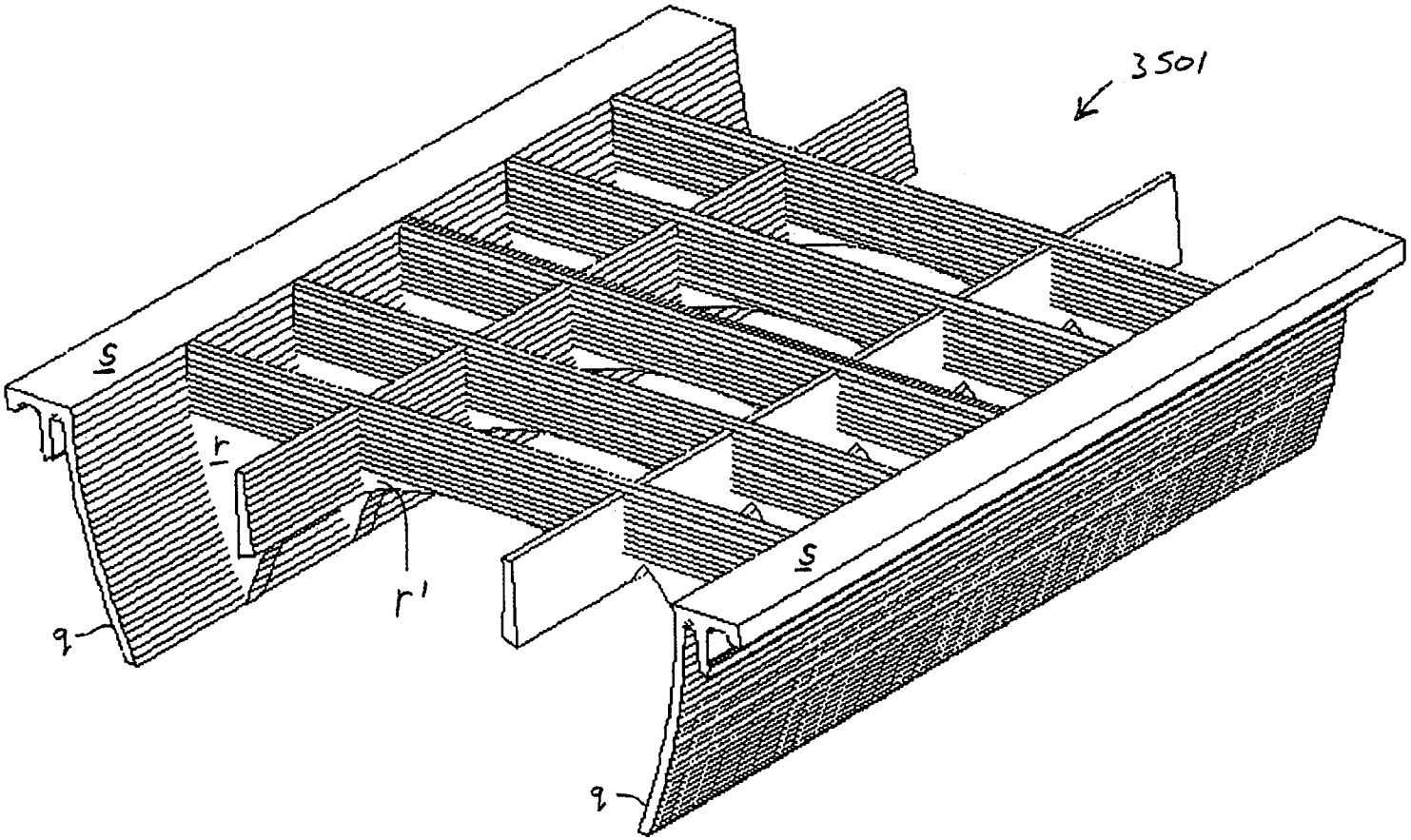

FIGS. 35*a,b* show still another embodiment of a louver assembly in accordance with the invention. Louver assembly 3501 is positioned in the top aperture of a direct/indirect luminaire 3500. Louver 3501 is fashioned uniquely for a lamp position differing from that of luminaire 3400 and for producing a shielding angle of 26°. Again, the louver is formed with extended side members that integrate additional reflector segments q into the assemblies. Louver 3501 also has horizontal top extensions s that facilitate mounting of the louver in a luminaire. Cross-blade fillets r facilitate one-piece molding techniques, and cross-blade extensions r' control the angle of light rays reflected from the bottom surfaces of the cross-blades. Notably, as in the previous two embodiments, the tops of the two interior longitudinal louver blades are nonplanar with and lie below (although slightly in this embodiment) the tops of the cross blades and side members. The longitudinal blades preferably have longitudinal sides with different curvatures as described above. The angle of maximum uptight intensity produced by louver 3501 again advantageously occurs within 15° of the shielding angle.

Figure 36A:
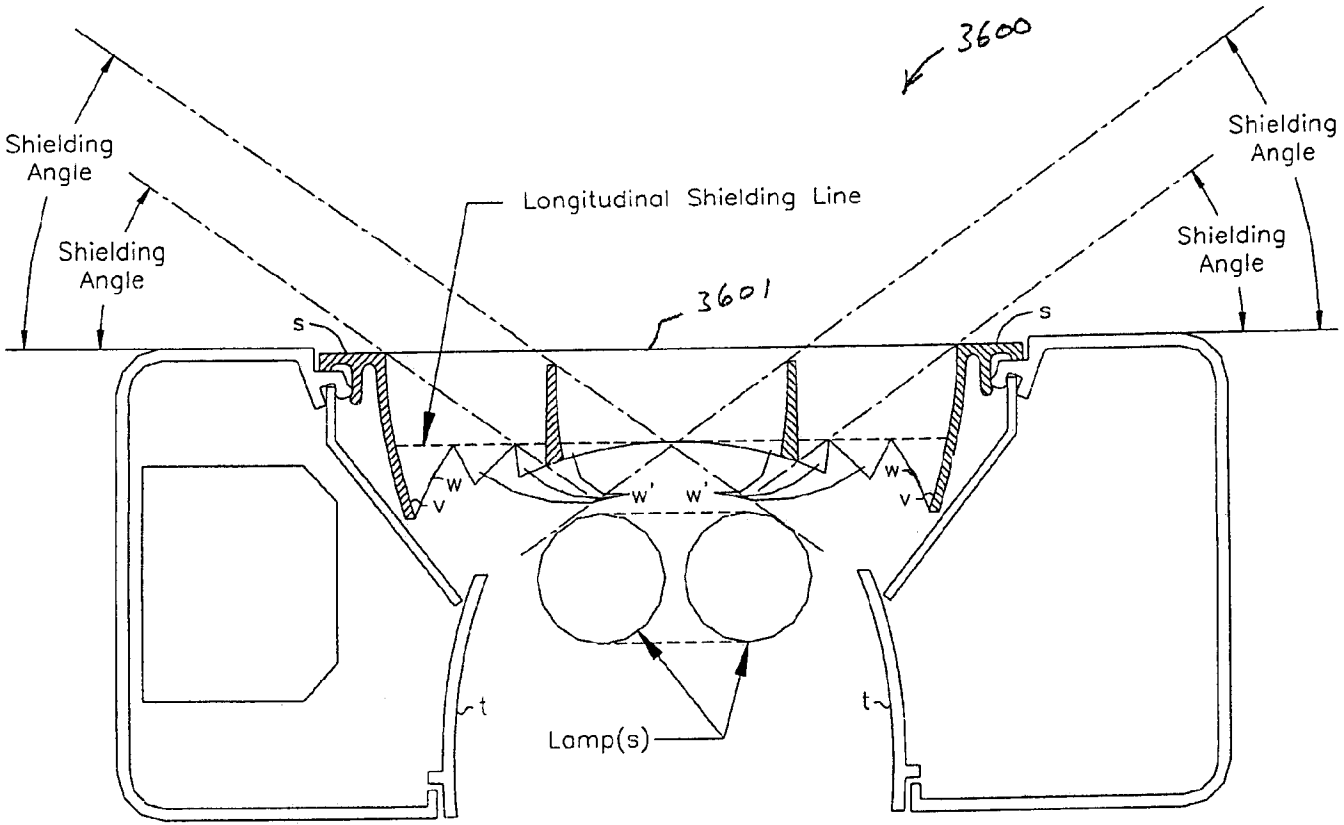
FIGS. 36*a,b* are cross-sectional and partial perspective views, respectively, of yet another embodiment of a louver assembly according to the invention.
Figure 36B:
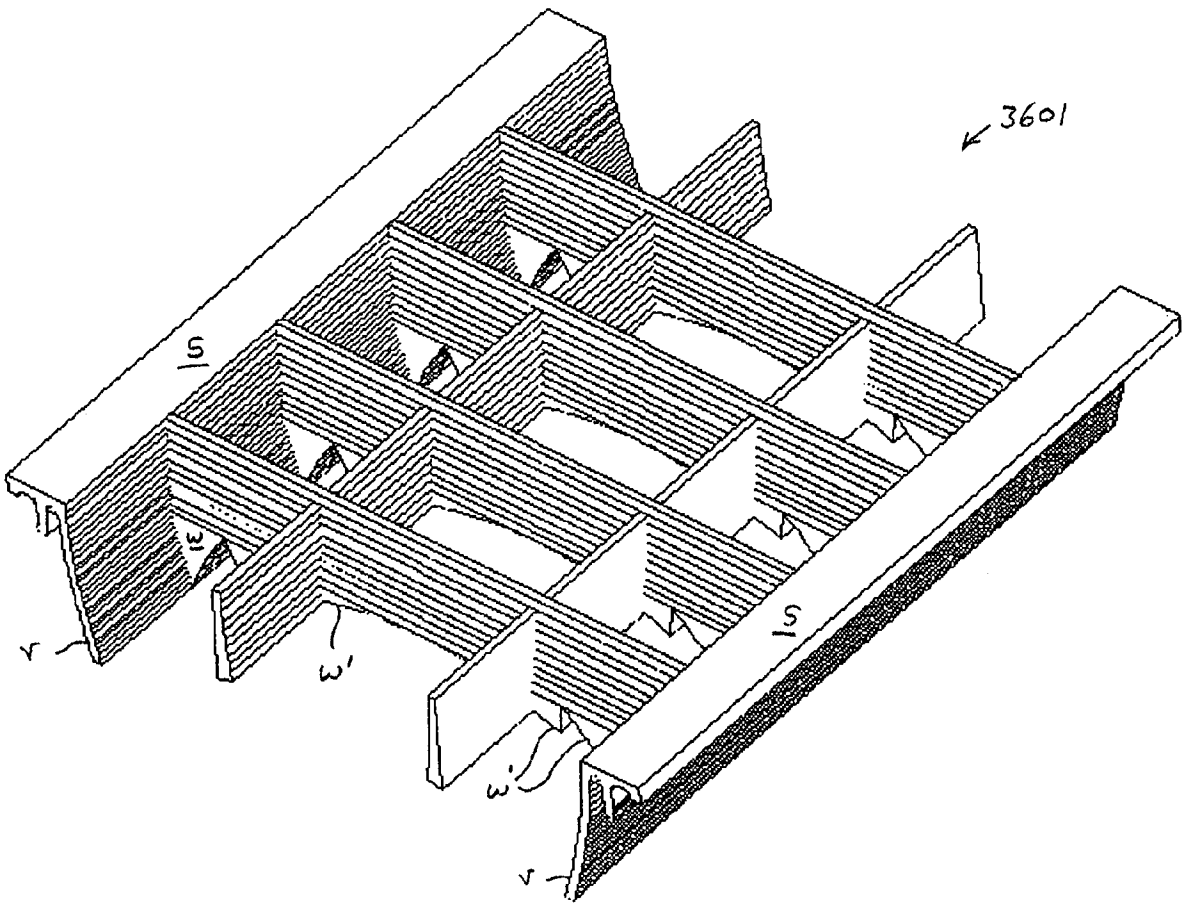

FIGS. 36*a,b* show yet another embodiment of a louver assembly in accordance with the invention. Louver assembly 3601 is positioned in the top aperture of a direct/indirect luminaire 3600. Louver 3601 is fashioned uniquely for a pair of lamps or twin-tube lamp to produce a shielding angle of 35°. Again, the louver is formed with extended side members that integrate additional reflector segments v into the assemblies. Louver 3601 is also formed with horizontal top extensions s that facilitate mounting of the louver in a luminaire. Louver 3601 is further formed with cross-blade fillets w to facilitate one-piece molding techniques. Cross-blade extensions w' control the angle of light rays reflected from the bottom surfaces of the cross blades. Notably, although the overall height of the two interior longitudinal louver blades is substantially similar to the effective height of the transverse louver blades (i.e., the height of the cross blades above the longitudinal shielding line), the tops of the longitudinal blades are set below the tops of the cross blades and side members (i.e., the tops are nonplanar) and, accordingly, the longitudinal louver blades extend beyond and below the longitudinal shielding line.

Figure 37A:
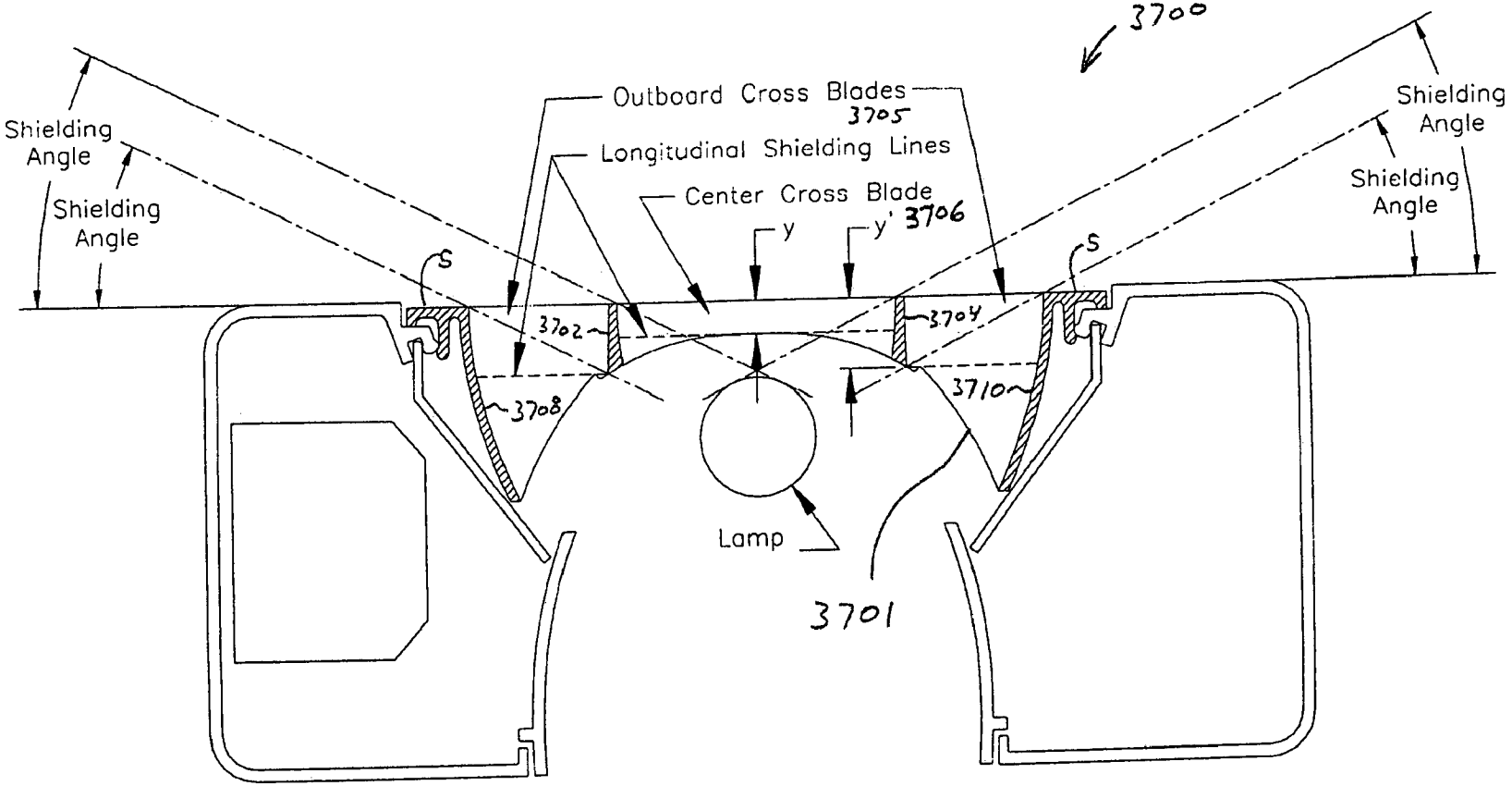
FIGS. 37*a,b* are cross-sectional and partial perspective views, respectively, of a further embodiment of a louver assembly according to the invention.
Figure 37B:
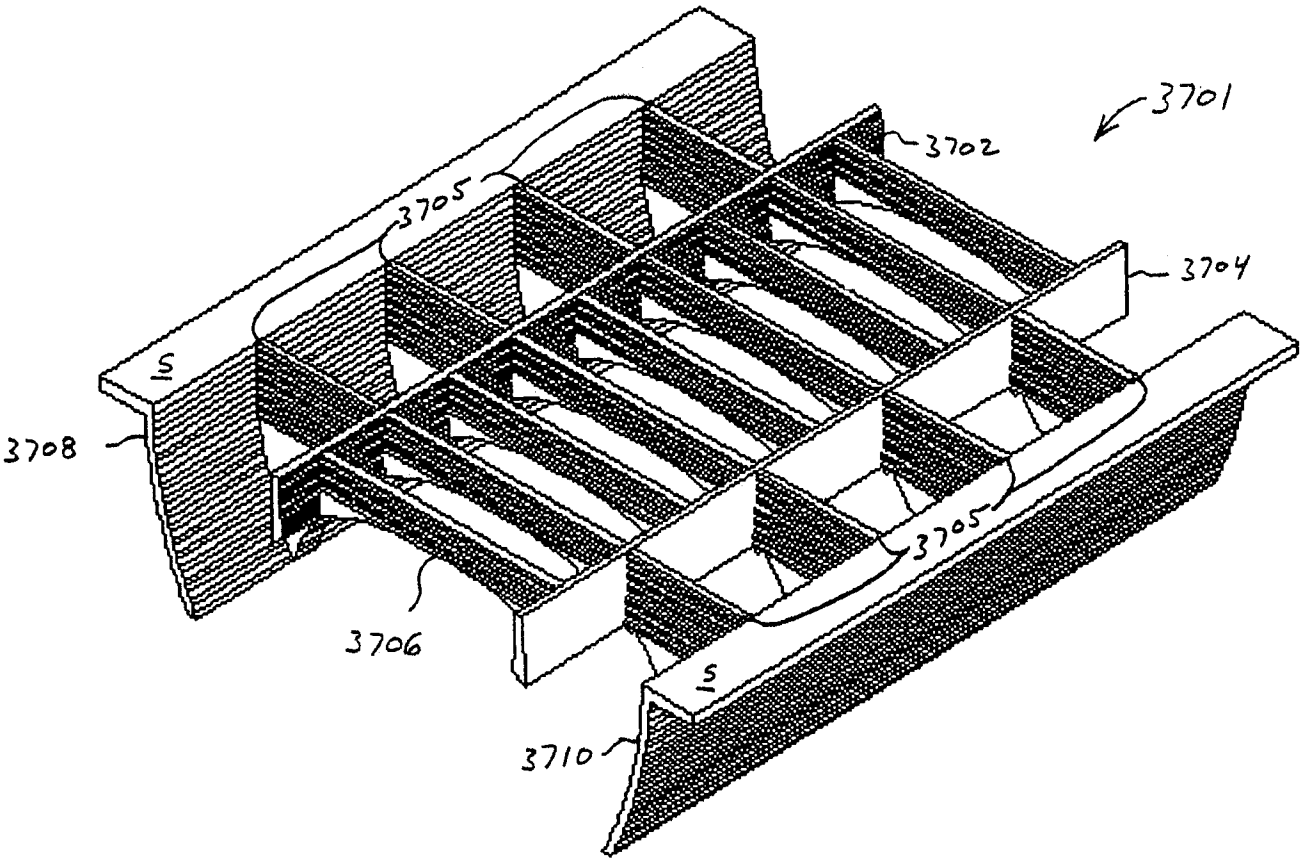

FIGS. 37*a,b* show a further embodiment of a louver assembly in accordance with the invention. Louver assembly 3701 is positioned in the top aperture of a direct/indirect luminaire 3700. In this embodiment, the tops of longitudinal blades 3702 and 3704 are planar with the tops of side members 3708 and 3710 and the cross blades. The cross blades are made up of either both outboard and center blade sections 3705 and 3706, or only center blade section 3706.

Because the longitudinal louver blades advantageously extend inward (i.e., downward as shown in FIG. 37*a*) and beyond the longitudinal shielding line of the center cells, the minimum effective aperture cell depth (designated y') of the outboard aperture cells is greater than the aperture cell depth (designated y) of the center aperture cells. Therefore, the spacing of the outboard cross blades can be increased relative to that of the center cross blades. Accordingly, the curved, low-brightness profile of the outboard cross blades is extended to a longitudinal shielding line occurring at a depth coinciding with the increased effective depth of the outboard cells. Specifically, in this embodiment, the shielding angle is 26° and the effective depth of the outboard louver cells y' is approximately twice the effective depth y of the center cells such that the spacing of the outboard cross blades is twice that of the center cross blades.

Other relative depth and spacing relationships are possible, including the omission of outboard cross blades 3705 entirely as suggested above, because any low angle direct lamp emanations they receive will otherwise be redirected to desirable angles by the adjacent (intersecting) side members. (In some constructions, however, these outboard cross blades may serve to position and/or support the longitudinal and center cross blades or prevent direct view of non-optical features within the luminaire.)

Notably, the performance of louver 3701 is substantially equivalent to the performance of louver 3501. While potentially more difficult to fabricate than louver assembly 3501, louvers such as 3701 employ cross blades of reduced height profile directly over the lamp (albeit there being more center cross blades at a reduced blade-to-blade spacing than louver 3501). This reduced height profile provides greater clearance between the lamp and the louver assembly, which may allow higher wattage (hotter) lamps to be used. Alternatively, the reduced louver height profile, combined with an increase in the size of the outboard aperture cells, may allow the luminaire height profile to be further reduced without adversely affecting efficiency.

Figure 38A:
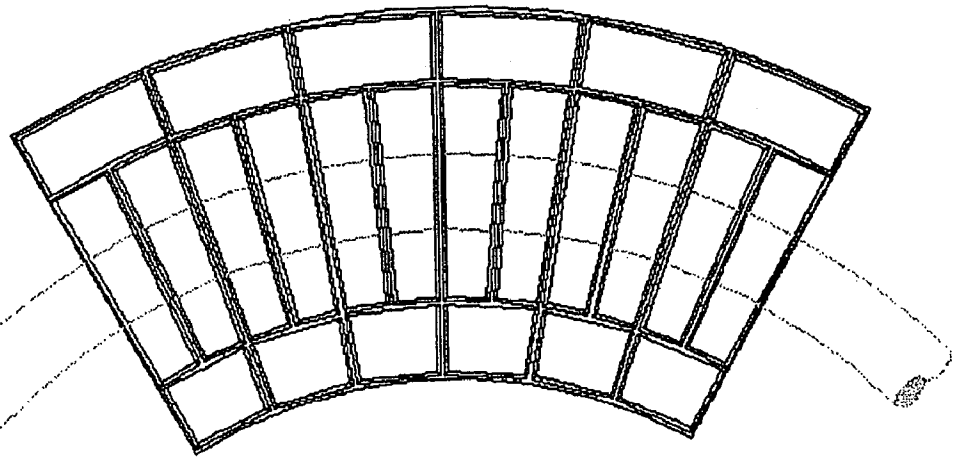
FIGS. 38*a,b* are partial top and partial cross-sectional views, respectively, of a circular embodiment of a louver assembly according to the invention.
Figure 38B:
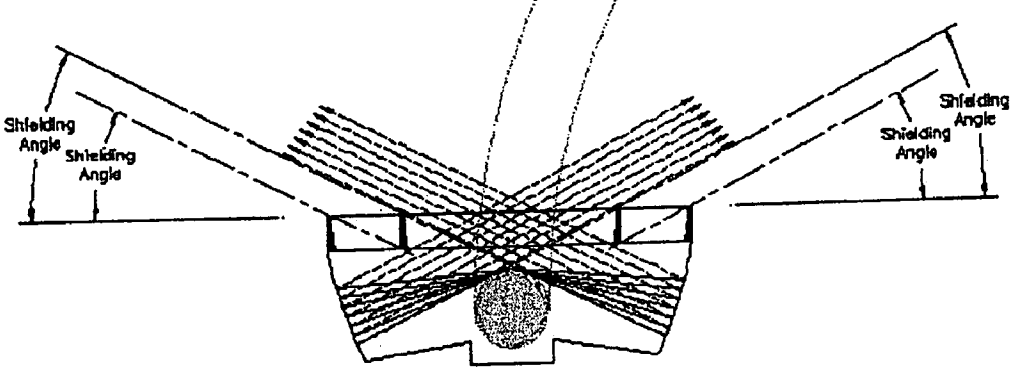
Figure 39A:
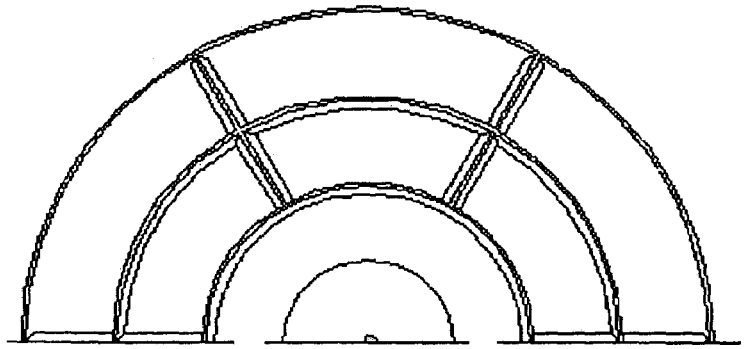
FIGS. 39*a,b* are partial top and cross-sectional views, respectively, of a concentric embodiment of a louver assembly according to the invention.
Figure 39B:
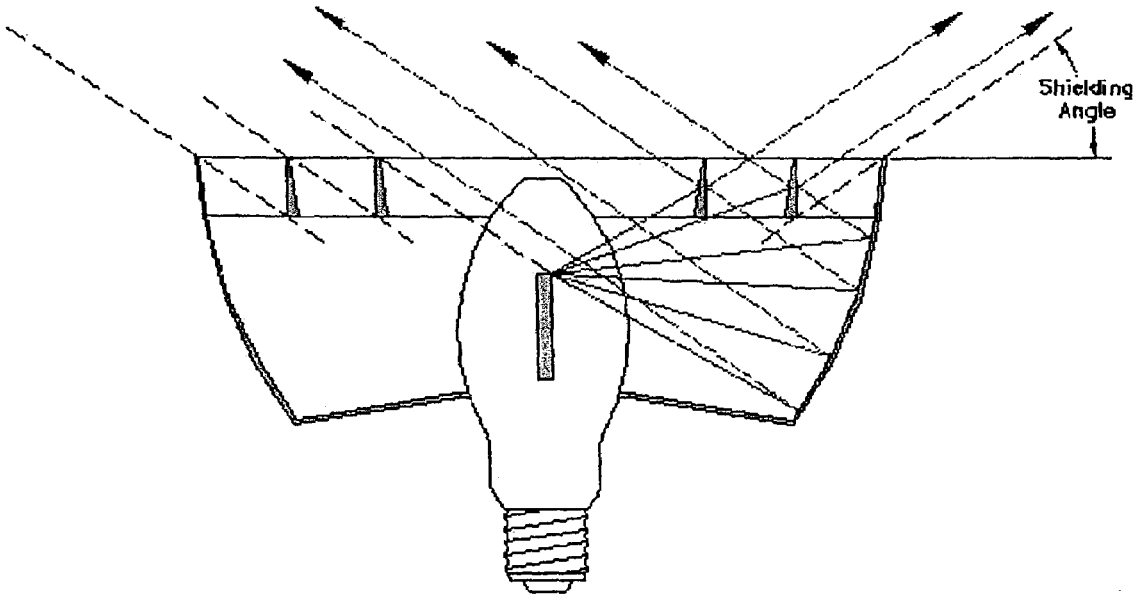

Louvers of the invention may also be used in direct luminaires, where the louver assembly is mounted in a light emitting opening in the bottom of the luminaire. Accordingly, louvers of the invention may further be used in direct/indirect luminaires having openings in their tops and bottoms, where the louver assembly may be mounted in the top opening (as shown in the embodiments above), the bottom opening, or both. Louvers of the invention may still further be used in luminaires employing multiple lamps, compact fluorescent lamps, circular type lamps, point sources such as tungsten-halogen and high-intensity discharge lamps, as well as other types of light sources. Furthermore, louvers of the invention may have non-orthogonal, concentric, and radial blade arrangements for use in luminaires with non-elongated light sources. FIGS. 38*a,b* and FIGS. 39*a,b* show such alternative embodiments of louver assemblies in accordance with the invention.

Thus it is seen that high performance louvers and luminaires are provided. One skilled in the art will appreciate that the invention can be practiced by other than the described embodiments, which are presented for purposes of illustration and not of limitation, and the present invention is limited only by the claims which follow.

I claim:

1. A louver assembly for a luminaire, said assembly comprising:

a plurality of transverse blades; and a plurality of longitudinal blades arranged with said transverse blades to form a plurality of apertures selected from the group consisting of:

a first plurality of apertures wherein each aperture of a first subplurality of said apertures has a larger area than each aperture of a second subplurality of said apertures;

a second plurality of apertures wherein each aperture of a first subplurality of said apertures has a greater transverse width than each aperture of a second subplurality of said apertures;

a third plurality of apertures wherein each of said transverse and longitudinal blades has a top and a bottom, said louver assembly mountable in a luminaire such that said bottoms of said transverse and longitudinal blades are nearer to a lamp of said luminaire than said tops of said transverse and longitudinal blades, at least one of said longitudinal blades having a top that is nonplanar with said transverse blade tops, said at least one longitudinal blade top positioned to be nearer said luminaire lamp than said transverse blade tops;

a fourth plurality of apertures wherein at least one of said longitudinal blades has a first longitudinal side having a first curvature and a second longitudinal side opposite said first side having a second curvature different than said first curvature; and a fifth plurality of apertures wherein a subplurality of said apertures forms inner apertures and another subplurality of said apertures forms outer apertures, said inner apertures transversely bounded by said outer apertures, each said aperture having a depth defined by the height of said transverse blades bounding said aperture, the aperture depth of said outer apertures being greater than the aperture depth of said inner apertures.

2. The louver assembly of claim 1 wherein most of said plurality of apertures are rectangularly-shaped.

3. The louver assembly of claim 1 wherein said larger area apertures are positioned transversely between said second subplurality of apertures.

4. The louver assembly of claim 1 wherein said greater transverse width apertures are positioned transversely between said second subplurality of apertures.

5. The louver assembly of claim 1 wherein said greater transverse width apertures are transversely centered in said louver assembly.

6. The louver assembly of claim 1 wherein said greater transverse width apertures are transversely centered with respect to one or more linear lamps of said luminaire.

7. The louver assembly of claim 1 wherein said first curvature comprises a planar shape.

8. The louver assembly of claim 1 wherein said second curvature comprises a parabolic shape.

9. The louver assembly of claim 1 wherein said first curvature comprises a planar shape and said first longitudinal side is positioned to receive no light directly from a luminaire lamp when said louver assembly is mounted in a luminaire.

10. The louver assembly of claim 1 wherein said second curvature comprises a parabolic shape and said second longitudinal side is positioned to receive light directly from a luminaire lamp when said louver assembly is mounted in a luminaire.

11. The louver assembly of claim 1 further comprising a pair of longitudinal side members, said side members defining the outermost longitudinal boundary and transverse width of said louver assembly.

12. A luminaire comprising:

a housing having an opening through which direct lamp light, reflected lamp light, or both exit;

at least one lampholder mounted within said housing; and a louver assembly positioned in or over said opening, said louver assembly comprising:

a plurality of transverse blades; and a plurality of longitudinal blades arranged with said transverse blades to form a plurality of apertures selected from the group consisting of:

a first plurality of apertures wherein each aperture of a first subplurality of said apertures has a larger area than each aperture of a second subplurality of said apertures;

a second plurality of apertures wherein each aperture of a first subplurality of said apertures has a greater transverse width than each aperture of a second subplurality of said apertures;

a third plurality of apertures wherein each of said transverse and longitudinal blades has a top and a bottom, said bottoms of said transverse and longitudinal blades are nearer to a lamp inserted in said lampholder than said tops of said transverse and longitudinal blades, at least one of said longitudinal blades having a top that is nonplanar with said transverse blade tops, said at least one longitudinal blade top positioned nearer to said luminaire lamp than said transverse blade tops;

a fourth plurality of apertures wherein at least one of said longitudinal blades has a first longitudinal side having a first curvature and a second longitudinal side opposite said first side having a second curvature different than said first curvature; and a fifth plurality of apertures wherein a subplurality of said apertures form outer apertures and another subplurality of said apertures form inner apertures, said inner apertures transversely bounded by said outer apertures, each said aperture having a depth defined by the height of said transverse blades bounding said aperture, the aperture depth of said outer apertures being greater than the aperture depth of said inner apertures.

13. The luminaire of claim 12 wherein most of said apertures are rectangularly-shaped.

14. The luminaire of claim 12 wherein said larger area apertures are positioned transversely between said second subplurality of apertures.

15. The luminaire of claim 12 wherein said greater transverse width apertures are positioned transversely between said second subplurality of apertures.

16. The luminaire of claim 12 wherein said greater transverse width apertures are transversely centered in said louver assembly.

17. The luminaire of claim 12 wherein said greater transverse width apertures are transversely centered with respect to one or more linear lamps of said luminaire.

18. The luminaire of claim 12 wherein said first curvature comprises a planar shape.

19. The luminaire of claim 12 wherein said second curvature comprises a parabolic shape.

20. The luminaire of claim 12 wherein said first curvature comprises a planar shape and said first longitudinal side is positioned to receive no light directly from a luminaire lamp inserted in said lampholder.

21. The luminaire of claim 12 wherein said second curvature comprises a parabolic shape and said second longitudinal side is positioned to receive light directly from a luminaire lamp inserted in said lampholder.

22. The luminaire of claim 12 wherein said louver assembly further comprises a pair of longitudinal side members, said side members defining the outermost longitudinal boundary and transverse width of said louver assembly.

23. A luminaire comprising:

a housing having an opening through which light rays exit; and a louver assembly positioned in or over said opening, said louver assembly comprising:

a plurality of transverse blades, and a plurality of longitudinal blades arranged with said transverse blades to form a plurality of apertures, wherein:

each aperture of a first subplurality of said apertures has a larger area than each aperture of a second subplurality of said apertures creating an area discrepancy between said first subplurality of said apertures and said second plurality of said apertures, wherein said area discrepancy is configured to prevent said light rays from being intercepted and redirected away from a sheilding angle, and configured to allow a wider distribution pattern of said light rays.

24. The luminaire of claim 23 wherein said larger area apertures are positioned transversely between said second subplurality of apertures.

25. A luminaire comprising:

a housing having an opening through which light rays exit; and a louver assembly positioned in or over said opening, said louver assembly comprising:

a plurality of transverse blades, and a plurality of longitudinal blades arranged with said transverse blades to form a plurality of apertures, wherein:

each aperture of a first subplurality of said apertures has a greater transverse width than each aperture of a second subplurality of said apertures creating a transverse width discrepancy between said first subplurality of said apertures and said second plurality of said apertures, wherein said transverse width discrepancy is configured to prevent said light rays from being intercepted and redirected away from a sheilding angle, and configured to allow a wider distribution pattern of said light rays.

26. The luminaire of claim 25 wherein said greater transverse width apertures are positioned transversely between said second subplurality of apertures.

27. The luminaire of claim 25 wherein said greater transverse width apertures are transversely centered in said louver assembly.

28. The luminaire of claim 25 wherein said greater transverse width apertures are transversely centered with respect to one or more linear lamps of said luminaire.

29. A luminaire comprising:

a housing having an opening through which direct lamp light, reflected lamp light, or both exit;

a louver assembly positioned in or over said opening, said louver assembly comprising:

a plurality of transverse blades, and a plurality of longitudinal blades arranged with said transverse blades to form a plurality of apertures, wherein:

each of said transverse and longitudinal blades has a top and a bottom, said bottoms of said transverse and longitudinal blades are nearer to a lamp of said luminaire than said tops of said transverse and longitudinal blades, at least one of said longitudinal blades having a top that is nonplanar with said transverse blade tops, said at least one longitudinal blade top positioned nearer to said luminaire lamp than said transverse blade tops.

30. A luminaire comprising:

a housing having an opening through which direct lamp light, reflected lamp light, or both exit; and a louver assembly positioned in or over in said opening, said louver assembly comprising:

a plurality of transverse blades, and a plurality of longitudinal blades arranged with said transverse blades to form a plurality of apertures, wherein:

at least one of said longitudinal blades has a first longitudinal side having a first curvature and a second longitudinal side opposite said first side having a second curvature different than said first curvature, wherein the first longitudinal side has an overall cross-sectional profile that is substantially different from an overall cross-sectional profile of the second longitudinal side.

31. The luminaire of claim 30 wherein said first curvature is planar and said second curvature is parabolic.

32. The luminaire of claim 30 wherein said first curvature comprises two shapes.

33. The luminaire of claim 32 wherein one of said two shapes is a parabola and the other of said two shapes is another parabola.

34. A luminaire comprising:

a housing having an opening through which direct lamp light, reflected lamp light, or both exit; and a louver assembly positioned in or over said opening, said louver assembly comprising:

a plurality of transverse blades, and a plurality of longitudinal blades arranged with said transverse blades to form a plurality of apertures, wherein:

a subplurality of said apertures form outer apertures and another subplurality of said apertures form inner apertures, said inner apertures transversely bounded by said outer apertures, each said aperture having a depth defined by the height of said transverse blades bounding said aperture, the aperture depth of said outer apertures being greater than the aperture depth of said inner apertures.

35. The luminaire of claim 34 wherein:

said transverse blades have a top and a bottom;

said top is planar;

said bottom is curved; and said height of said transverse blades is the shortest measurement made perpendicularly from said top to said bottom.

* * * * *